US010539889B2

(12) United States Patent
Iwashita et al.

(10) Patent No.: US 10,539,889 B2
(45) Date of Patent: Jan. 21, 2020

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Yuko Iwashita, Osaka (JP); Kazunari Hamasaki, Osaka (JP); Kazutaka Sugimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/260,255

(22) Filed: Jan. 29, 2019

(65) Prior Publication Data

US 2019/0235400 A1 Aug. 1, 2019

(30) Foreign Application Priority Data

Jan. 31, 2018 (JP) ..... 2018-014337

(51) Int. Cl.
*G03G 5/05* (2006.01)
*G03G 5/06* (2006.01)

(52) U.S. Cl.
CPC ..... *G03G 5/0564* (2013.01); *G03G 5/0609* (2013.01); *G03G 5/0614* (2013.01); (Continued)

(58) Field of Classification Search
CPC .. G03G 5/0564; G03G 5/0614; G03G 5/0609; G03G 5/0638; G03G 5/0618
See application file for complete search history.

(56) References Cited

U.S. PATENT DOCUMENTS 10,001,714 B2 6/2018 Hirakata et al.
2002/0098428 A1* 7/2002 Watanabe ..... G03G 5/0564 430/56

(Continued)

FOREIGN PATENT DOCUMENTS

JP 2003255569 A * 9/2003
JP 2010237555 A * 10/2010

(Continued)

OTHER PUBLICATIONS

English language machine translation of JP 6413548 (Year: 2018).*

(Continued)

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer of a single layer. The photosensitive layer contains a charge generating material, a hole transport material, an electron transport material, and a binder resin. An optical response time is at least 0.05 milliseconds and no greater than 0.85 milliseconds. The binder resin includes a polycarbonate resin including a repeating unit represented by general formula (1) shown below and a repeating unit represented by general formula (2) shown below.

(1)

(Continued)

-continued (2)

11 Claims, 6 Drawing Sheets

(52) U.S. Cl.
CPC ..... *G03G 5/0618* (2013.01); *G03G 5/0638* (2013.01); *G03G 5/0651* (2013.01); *G03G 5/0672* (2013.01); *G03G 5/0675* (2013.01); *G03G 5/0696* (2013.01)

(56) References Cited

U.S. PATENT DOCUMENTS

2016/0357118 A1* 12/2016 Tsurumi ..... G03G 5/0614
2017/0090307 A1 3/2017 Hirakata et al.
2017/0242353 A1* 8/2017 Fuchigami ..... G03G 5/047
2018/0196364 A1* 7/2018 Yamada ..... G03G 5/04
2019/0235399 A1* 8/2019 Iwashita ..... G03G 5/047

FOREIGN PATENT DOCUMENTS

JP 2016090611 A * 5/2016
JP 2017062400 A 3/2017
JP 2017114807 A * 6/2017
JP 6413548 B2 * 10/2018
WO WO-2018198590 A1 * 11/2018 ..... G03G 5/04

OTHER PUBLICATIONS

English langauge machine translation of JP 2003-255569 (Year: 2003).*
English langauge machine translation of JP 2010-237555 (Year: 2010).*
English langauge machine translation of JP 2016-090611 (Year: 2016).*
English language machine translation of JP 2017-114807. (Year: 2017).*
English language machine translation of WO 2018-198590. (Year: 2018).*

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2018-014337, filed on Jan. 31, 2018. The contents of this application are incorporated herein by reference in their entirety.

BACKGROUND

The present disclosure relates to an electrophotographic photosensitive member, a process cartridge, and an image forming apparatus.

Electrophotographic photosensitive members are used in electrographic image forming apparatuses. For example, a multi-layer electrophotographic photosensitive member or a single-layer electrophotographic photosensitive member is used as an electrophotographic photosensitive member. The electrophotographic photosensitive member includes a photosensitive layer. The multi-layer electrophotographic photosensitive member includes, as the photosensitive layer, a charge generating layer having a charge generating function and a charge transport layer having a charge transporting function. The single-layer electrophotographic photosensitive member includes, as the photosensitive layer, a photosensitive layer that is a single layer having the charge generating function and the charge transporting function.

In an example of the electrophotographic photosensitive member, a polycarbonate resin formed through homopolymerization of bisphenol Z is preferable as a binder resin.

SUMMARY

An electrophotographic photosensitive member according to an aspect of the present disclosure includes a conductive substrate and a photosensitive layer of a single layer. The photosensitive layer contains a charge generating material, a hole transport material, an electron transport material, and a binder resin. An optical response time is at least 0.05 milliseconds and no greater than 0.85 milliseconds. The optical response time is a time from irradiation to decay. The irradiation is a time of a start of irradiation of a surface of the photosensitive layer charged to +800 V with pulse light having a wavelength of 780 nm. The decay is a time when a surface potential of the photosensitive layer decays from +800 V to +400 V. An optical intensity of the pulse light is set so that the surface potential of the photosensitive layer becomes +200 V from +800 V when 400 milliseconds elapse after the irradiation of the surface of the photosensitive layer charged to +800 V with the pulse light. The binder resin includes a polycarbonate resin including a repeating unit represented by general formula (1) shown below and a repeating unit represented by general formula (2) shown below.

(1)

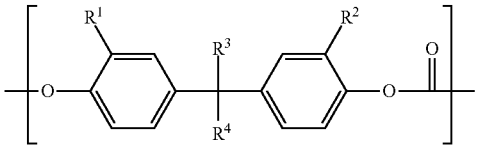

-continued (2)

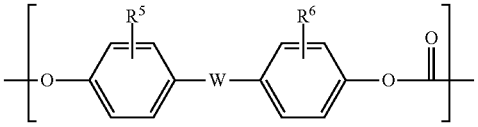

In general formula (1), $R^1$, $R^2$, $R^3$, and $R^4$ each represent, independently of one another, a hydrogen atom, an alkyl group having a carbon number of at least 1 and no greater than 3 and optionally substituted by a halogen atom, or an aryl group having a carbon number of at least 6 and no greater than 14. $R^3$ and $R^4$ may be bonded together to form a ring of a divalent group represented by general formula (X) shown below. In general formula (2), $R^5$ and $R^6$ each represent, independently of each other, a hydrogen atom or an alkyl group having a carbon number of at least 1 and no greater than 3 and optionally substituted by a substituent. W represents a single bond, —O—, or —CO—.

(X)

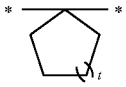

In general formula (X), t represents an integer of at least 1 and no greater than 3. Also, * represents a bond.

A process cartridge according to an aspect of the present disclosure includes the electrophotographic photosensitive member described above.

An image forming apparatus according to an aspect of the present disclosure includes an image bearing member, a charger, a light exposure section, a developing section, and a transfer section. The charger charges a surface of the image bearing member. The light exposure section exposes the charged surface of the image bearing member to light to form an electrostatic latent image on the surface of the image bearing member. The developing section develops the electrostatic latent image into a toner image. The transfer section transfers the toner image from the image bearing member to a transfer target. The charger positively charges the surface of the image bearing member. The image bearing member is the electrophotographic photosensitive member described above.

DETAILED DESCRIPTION

Figure 1A:
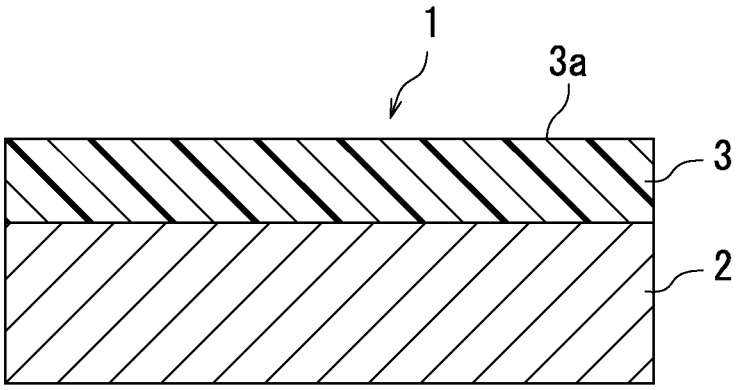
FIG. 1A is a partial cross-sectional view illustrating an example of an electrophotographic photosensitive member according to a first embodiment of the present disclosure.

Hereinafter, embodiments of the present disclosure will be described. The present disclosure is not in any way limited by the following embodiments. The present disclosure can be practiced within a scope of objects of the present disclosure with alterations made as appropriate. Although some overlapping explanations may be omitted as appropriate, such omission does not limit the gist of the present disclosure.

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

Hereinafter, the following definitions apply to a halogen atom, an alkyl group having a carbon number of at least 1 and no greater than 12, an alkyl group having a carbon number of at least 1 and no greater than 6, an alkyl group having a carbon number of at least 1 and no greater than 5, an alkyl group having a carbon number of at least 1 and no greater than 4, an alkyl group having a carbon number of at least 1 and no greater than 3, an alkenyl group having a carbon number of at least 2 and no greater than 4, an alkoxy group having a carbon number of at least 1 and no greater than 6, an alkoxy group having a carbon number of at least 1 and no greater than 3, an aryl group having a carbon number of at least 6 and no greater than 14, an aryl group having a carbon number of at least 6 and no greater than 10, an aralkyl group having a carbon number of at least 7 and no greater than 20, an aralkyl group having a carbon number of at least 7 and no greater than 16, a heterocyclic group, and a cycloalkane having a carbon number of at least 5 and no greater than 7, unless otherwise stated.

Examples of halogen atoms include a fluorine atom, a chlorine atom, a bromine atom, and an iodine atom.

The alkyl group having a carbon number of at least 1 and no greater than 12, the alkyl group having a carbon number of at least 1 and no greater than 6, the alkyl group having a carbon number of at least 1 and no greater than 5, the alkyl group having a carbon number of at least 1 and no greater than 4, and the alkyl group having a carbon number of at least 1 and no greater than 3 each are an unsubstituted straight chain or branched chain alkyl group. Examples of alkyl groups having a carbon number of at least 1 and no greater than 12 include methyl group, ethyl group, n-propyl group, isopropyl group, n-butyl group, sec-butyl group, tert-butyl group, pentyl group, isopentyl group, 1,1-dimethylpropyl group, neopentyl group, hexyl group, heptyl group, octyl group, nonyl group, decyl group, undecyl group, and dodecyl group. Examples of alkyl groups having a carbon number of at least 1 and no greater than 6 are the groups having a carbon number of at least 1 and no greater than 6 among the above-listed examples of alkyl groups having a carbon number of at least 1 and no greater than 12. Examples of alkyl groups having a carbon number of at least 1 and no greater than 5 are the groups having a carbon number of at least 1 and no greater than 5 among the above-listed examples of alkyl groups having a carbon number of at least 1 and no greater than 12. Examples of alkyl groups having a carbon number of at least 1 and no greater than 4 are the groups having a carbon number of at least 1 and no greater than 4 among the above-listed examples of alkyl groups having a carbon number of at least 1 and no greater than 12. Examples of alkyl groups having a carbon number of at least 1 and no greater than 3 are the groups having a carbon number of at least 1 and no greater than 3 among the above-listed examples of alkyl groups having a carbon number of at least 1 and no greater than 12.

The alkenyl group having a carbon number of at least 2 and no greater than 4 is an unsubstituted straight chain or branched chain alkenyl group. The alkenyl group having a carbon number of at least 2 and no greater than 4 has one or two double bonds. Examples of alkenyl groups having a carbon number of at least 2 and no greater than 4 include ethenyl group, propenyl group, butenyl group, and butadienyl group.

The alkoxy group having a carbon number of at least 1 and no greater than 6 and the alkoxy group having a carbon number of at least 1 and no greater than 3 each are an unsubstituted straight chain or branched chain alkoxy group. Examples of alkoxy groups having a carbon number of at least 1 and no greater than 6 include methoxy group, ethoxy group, n-propoxy group, isopropoxy group, n-butoxy group, sec-butoxy group, tert-butoxy group, pentyloxy group, isopentyloxy group, neopentyloxy group, and hexyloxy group. Examples of alkoxy groups having a carbon number of at least 1 and no greater than 3 are the groups having a carbon number of at least 1 and no greater than 3 among the above-listed examples of alkoxy groups having a carbon number of at least 1 and no greater than 6.

The aryl group having a carbon number of at least 6 and no greater than 14 and the aryl group having a carbon number of at least 6 and no greater than 10 each are an unsubstituted aryl group. Examples of aryl groups having a carbon number of at least 6 and no greater than 14 include phenyl group, naphthyl group, indacenyl group, biphenylenyl group, acenaphthylenyl group, anthryl group, and phenanthryl group. Examples of aryl groups having a carbon number of at least 6 and no greater than 10 include phenyl group and naphthyl group.

The aralkyl group having a carbon number of at least 7 and no greater than 20 and the aralkyl group having a carbon number of at least 7 and no greater than 16 each are an unsubstituted aralkyl group. Examples of aralkyl groups having a carbon number of at least 7 and no greater than 20 include an alkyl group having a carbon number of at least 1 and no greater than 6 and substituted by an aryl group having a carbon number of at least 6 and no greater than 14. Examples of aralkyl groups having a carbon number of at least 7 and no greater than 16 include an alkyl group having a carbon number of 1 or 2 and substituted by an aryl group having a carbon number of at least 6 and no greater than 14.

Examples of heterocyclic groups include a heterocyclic group having at least 5 members and no greater than 14 members. The heterocyclic group having at least 5 members and no greater than 14 members is an unsubstituted heterocyclic group having at least 1 hetero atom in addition to carbon atoms. The hetero atom is at least one atom selected from the group consisting of a nitrogen atom, a sulfur atom, and an oxygen atom. Examples of heterocyclic groups having at least 5 members and no greater than 14 members include: a heterocyclic group having a five- or six-membered monocyclic heterocyclic ring having at least 1 and no greater than 3 hetero atoms in addition to carbon atoms; a heterocyclic group formed through condensation of two monocyclic heterocyclic rings such as above; a heterocyclic group formed through condensation of a monocyclic heterocyclic ring such as above and a five- or six-membered monocyclic hydrocarbon ring; a heterocyclic group formed through condensation of three monocyclic heterocyclic rings such as above; a heterocyclic group formed through condensation of two monocyclic heterocyclic rings such as above and one five- or six-membered monocyclic hydrocarbon ring; and a heterocyclic group formed through condensation of one monocyclic heterocyclic ring such as above and two five- or six-membered monocyclic hydrocarbon rings. Specific examples of heterocyclic groups having at least 5 members and no greater than 14 members include piperidinyl group, piperazinyl group, morpholinyl group, thiophenyl group, furanyl group, pyrrolyl group, imidazolyl group, pyrazolyl group, isothiazolyl group, isoxazolyl group, oxazolyl group, thiazolyl group, furazanyl group, pyranyl group, pyridyl group, pyridazinyl group, pyrimidinyl group, pyrazinyl group, indolyl group, 1H-indazolyl group, isoindolyl group, chromenyl group, quinolinyl group, isoquinolinyl group, purinyl group, pteridinyl group, triazolyl group, tetrazolyl group, 4H-quinolizinyl group, naphthyridinyl group, benzofuranyl group, 1,3-benzodioxolyl group, benzoxazolyl group, benzothiazolyl group, benzimidazolyl group, carbazolyl group, phenanthridinyl group, acridinyl group, phenadinyl group, and phenanthrolinyl group.

The cycloalkane having a carbon number of at least 5 and no greater than 7 is an unsubstituted cycloalkane. Examples of cycloalkanes having a carbon number of at least 5 and no greater than 7 include cyclopentane, cyclohexane, and cycloheptane.

<First Embodiment: Electrophotographic Photosensitive Member>

Figure 1B:
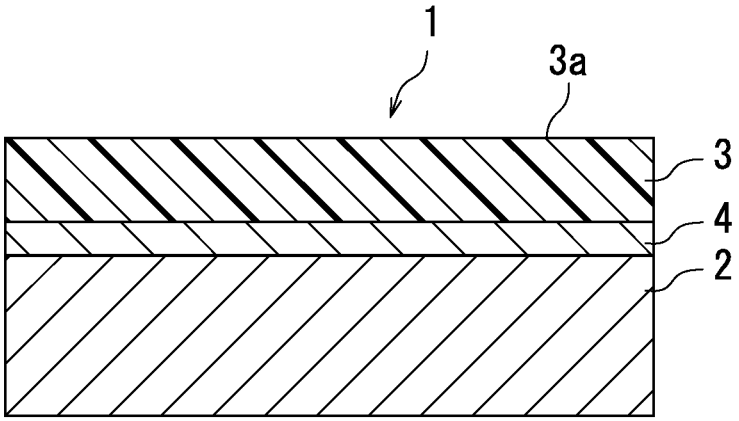
FIG. 1B is a partial cross-sectional view illustrating another example of the electrophotographic photosensitive member according to the first embodiment of the present disclosure.

A first embodiment relates to an electrophotographic photosensitive member (also referred to below as a photosensitive member). The following describes structure of a photosensitive member 1 with reference to FIGS. 1A and 1B. FIGS. 1A and 1B are cross-sectional views each illustrating an example of the photosensitive member 1 according to the first embodiment.

As illustrated in FIG. 1A, the photosensitive member 1 includes for example a conductive substrate 2 and a photosensitive layer 3. The photosensitive layer 3 is a single layer (one layer). The photosensitive member 1 is a single-layer electrophotographic photosensitive member including the photosensitive layer 3 of a single layer.

As illustrated in FIG. 1B, the photosensitive member 1 may include an intermediate layer 4 (undercoat layer) in addition to the conductive substrate 2 and the photosensitive layer 3. The intermediate layer 4 is disposed between the conductive substrate 2 and the photosensitive layer 3. The photosensitive layer 3 may be disposed directly on the conductive substrate 2 as illustrated in FIG. 1A. Alternatively, the photosensitive layer 3 may be disposed on the conductive substrate 2 with the intermediate layer 4 therebetween as illustrated in FIG. 1B. The intermediate layer 4 may include one layer or a plurality of layers.

The photosensitive member 1 may further include a protective layer (not illustrated) in addition to the conductive substrate 2 and the photosensitive layer 3. The protective layer is disposed on the photosensitive layer 3. The protective layer may include one layer or a plurality of layers.

The thickness of the photosensitive layer 3 is not particularly limited. The photosensitive layer 3 preferably has a thickness of at least 5 μm and no greater than 100 μm, and more preferably at least 10 μm and no greater than 50 μm. The structure of the photosensitive member 1 has been described with reference to FIGS. 1A and 1B.

The following describes the photosensitive member further in detail.

<Photosensitive Layer>

The photosensitive layer contains a charge generating material, a hole transport material, an electron transport material, and a binder resin.

(Optical Response Time)

An optical response time of the photosensitive member is at least 0.05 milliseconds and no greater than 0.85 milliseconds. The optical response time is a time from a time of a start of irradiation of a surface of the photosensitive layer charged to +800 V with pulse light having a wavelength of 780 nm to a time when a surface potential of the photosensitive layer decays from +800 V to +400 V. An optical intensity of the pulse light is set so that the surface potential of the photosensitive layer becomes +200 V from +800 V when 400 milliseconds elapse after the irradiation of the surface of the photosensitive layer charged to +800 V with the pulse light having a wavelength of 780 nm.

Figure 2:
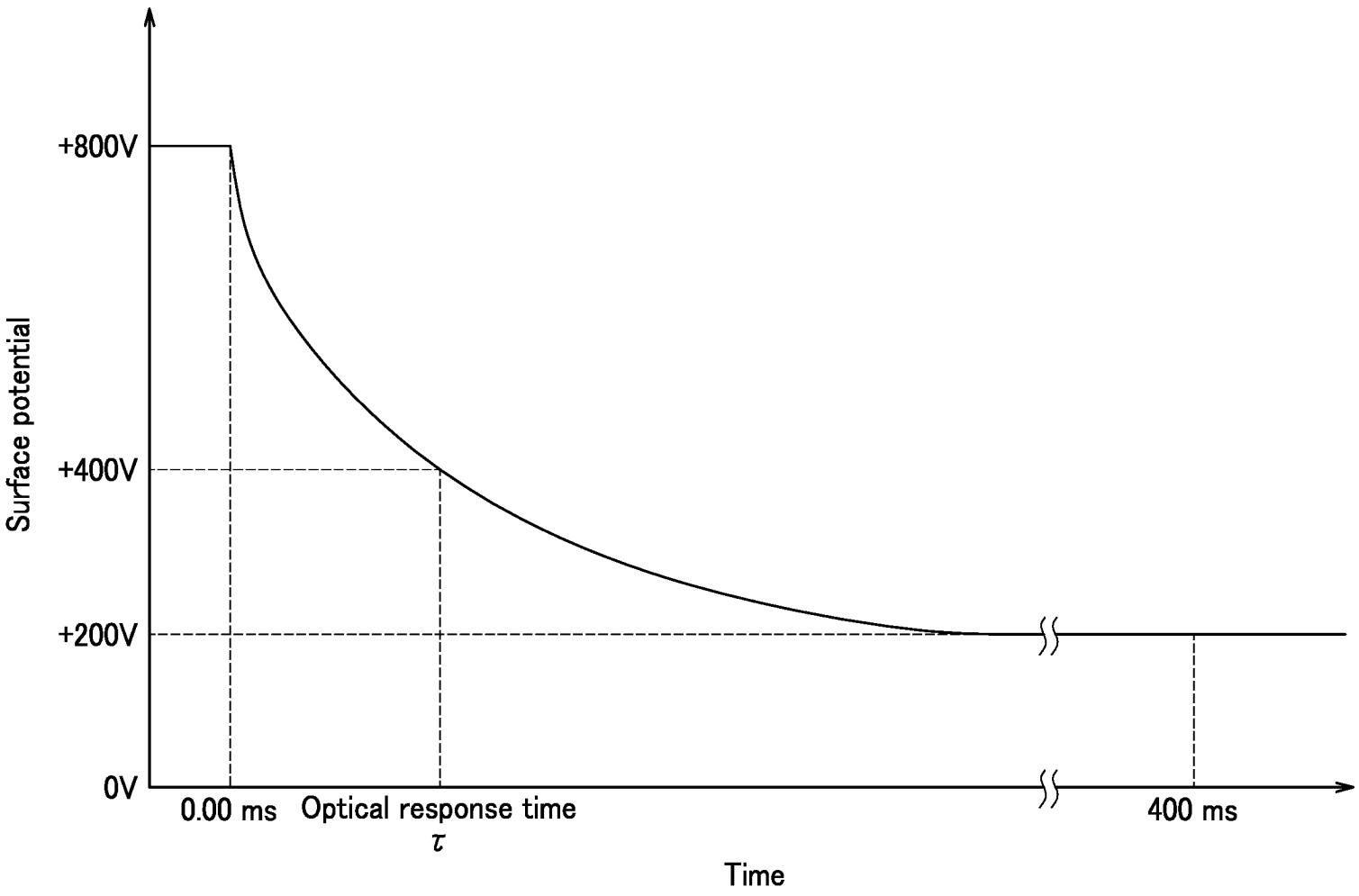
FIG. 2 is a graph representation showing a surface potential decay curve of a photosensitive layer.

The following describes the optical response time with reference to FIG. 2. FIG. 2 is a graph representation showing a surface potential decay curve of a photosensitive layer. A vertical axis of the graph representation represents surface potential (unit: V) of the photosensitive layer. A horizontal axis represents elapse of time. On the surface potential decay curve of the photosensitive layer, a time point when the surface of the photosensitive layer is irradiated with the pulse light (more precisely, a time point when output of the pulse light with which the surface of the photosensitive layer is irradiated exhibits peak output) is determined to be 0.00 milliseconds. As shown by the surface potential decay curve of the photosensitive layer, the surface potential of the photosensitive layer decays from +800 V to +200 V when 400 milliseconds elapse after irradiation of the surface of the photosensitive layer charged to +800 V with the pulse light. Here, a time t from irradiation of the surface of the photosensitive layer charged to +800 V with the pulse light to decay of the surface potential of the photosensitive layer from +800 V to +400 V is taken to be an optical response time.

When the optical response time of the photosensitive member is at least 0.05 milliseconds and no greater than 0.85 milliseconds, an image defect resulting from exposure memory can be inhibited and excellent sensitivity stability can be achieved. The exposure memory herein means a phenomenon in which influence of light exposure in image formation causes charge potential of a surface region of a photosensitive member in the current turn corresponding to an exposure region thereof in the previous turn to be lower than charge potential of a surface region of the photosensitive member corresponding to a non-exposure region in the previous turn. When exposure memory occurs, an image defect described as a darken region corresponding to the exposure region of the photosensitive member in the previous turn occurs in a formed image. When the optical response time of the photosensitive member exceeds 0.85 milliseconds, electrical charge (particularly, holes) tends to remain in the photosensitive layer. Accordingly, sensitivity stability is impaired and an image defect resulting from exposure memory occur. Note that it takes some time for the photosensitive member to make optical response, and therefore, a lower limit of the optical response time of the photosensitive member may be 0.05 milliseconds.

In order to inhibit an image defect resulting from exposure memory, an upper limit of the optical response time of the photosensitive member is preferably 0.60 milliseconds, more preferably 0.45 milliseconds, particularly preferably 0.40 milliseconds, and furthermore preferably 0.28 milliseconds.

The optical response time of the photosensitive member is measured by a method described in Examples. The optical response time of the photosensitive member can be adjusted for example by changing a type of the hole transport material. The optical response time of the photosensitive member can be also adjusted for example by changing a type of the electron transport material. The optical response time of the photosensitive member can be also adjusted for example by changing a type of an additive that may be optionally added as needed. Furthermore, the optical response time of the photosensitive member can be adjusted for example by changing a content of the hole transport material relative to a mass of the photosensitive layer. In addition, the optical response time of the photosensitive member can be adjusted for example by changing a ratio $m_{HTM}/m_{ETM}$ of a mass $m_{HTM}$ of the hole transport material to a mass $m_{ETM}$ of the electron transport material.

(Binder Resin)

The binder resin includes a polycarbonate resin (also referred to below as a polycarbonate resin (10)) including a repeating unit represented by general formula (1) (also referred to below as a repeating unit (1)) shown below and a repeating unit represented by general formula (2) (also referred to below as a repeating unit (2)) shown below. The binder resin may further include a polycarbonate resin other than the polycarbonate resin (10). The binder resin may further include another resin that is not a polycarbonate resin. That is, one binder resin may be used independently, or two or more binder resins may be used in combination.

(1)

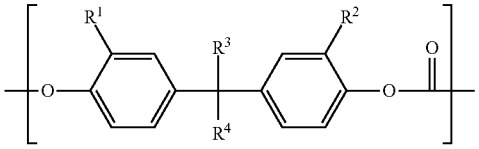

(2)

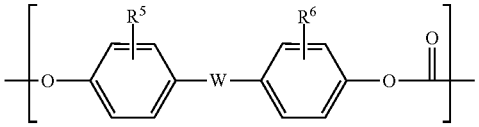

In general formula (1), $R^1$, $R^2$, $R^3$, and $R^4$ each represent, independently of one another, a hydrogen atom, an alkyl group having a carbon number of at least 1 and no greater than 3 and optionally substituted by a halogen atom, or an aryl group having a carbon number of at least 6 and no greater than 14. $R^3$ and $R^4$ may be bonded together to form a ring of a divalent group represented by general formula (X) shown below. In general formula (2), $R^5$ and $R^6$ each represent, independently of each other, a hydrogen atom or an alkyl group having a carbon number of at least 1 and no greater than 3 and optionally substituted by a substituent. W represents a single bond, —O—, or —CO—.

(X)

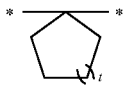

In general formula (X), t represents an integer of at least 1 and no greater than 3. Also, * represents a bond.

As a result of the binder resin in the photosensitive layer including the polycarbonate resin (10), an image defect resulting from a scratch or filming can be inhibited and excellent sensitivity stability can be achieved. Presumably, the reason therefor is as follows. Through long-term repetitive use of an image forming apparatus with a typical photosensitive member, a load is applied to the photosensitive member to form a scratch on the photosensitive layer. Once a scratch such as above is formed on the surface of the photosensitive layer, toner may enter the scratch to invite filming and sensitivity may reduce due to the presence of the scratch. Scratch formation on the surface of the photosensitive layer or filming resulting from such a scratch tends to occur particularly in a high-speed apparatus in which the photosensitive member receives a large load. By contrast, when the binder resin in the photosensitive layer includes the polycarbonate resin (10) that is a copolymer including the repeating units (1) and (2), appropriate strength is imparted to the photosensitive layer, with a result that a scratch or filming resulting from a scratch is hardly caused. Thus, an image defect resulting from a scratch or filming can be inhibited and sensitivity stability can be improved.

Note that the polycarbonate resin (10) may be any of a random copolymer, an alternating copolymer, and a block copolymer.

In general formula (1), the alkyl group having a carbon number of at least 1 and no greater than 3 represented by any of $R^1$, $R^2$, $R^3$, and $R^4$ is preferably a methyl group or an ethyl group, and more preferably a methyl group. The alkyl group having a carbon number of at least 1 and no greater than 3 represented by any of $R^1$, $R^2$, $R^3$, and $R^4$ may be substituted by a halogen atom as a substituent.

In general formula (1), the aryl group having a carbon number of at least 6 and no greater than 14 represented by any of $R^1$, $R^2$, $R^3$, and $R^4$ is preferably an aryl group having a carbon number of at least 6 and no greater than 10, and more preferably a phenyl group.

Examples of divalent groups each as a ring formed through boning between $R^3$ and $R^4$ in general formula (1) and represented by general formula (X) include divalent groups represented by chemical formulas (X-1), (X-2), and (X-3) shown below, and the divalent group represented by chemical formula (X-2) is preferable. In chemical formulas (X-1), (X-2), and (X-3), * represents a bond.

(X-1)

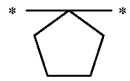

(X-2)

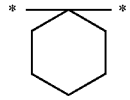

(X-3)

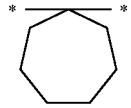

In general formula (1), $R^1$ and $R^2$ each preferably represent a hydrogen atom or an alkyl group having a carbon number of at least 1 and no greater than 3. Note that $R^1$ and $R^2$ in general formula (1) are preferably the same as each other.

In general formula (1), $R^3$ and $R^4$ preferably each represent an alkyl group having a carbon number of at least 1 and no greater than 3 or an aryl group having a carbon number of at least 6 and no greater than 14, or are bonded together to form a ring. Note that in a situation in which $R^3$ and $R^4$ represent an alkyl group having a carbon number of at least 1 and no greater than 3 or an aryl group having a carbon number of at least 6 and no greater than 14, it is preferable that $R^3$ and $R^4$ each represent an alkyl group having a carbon number of at least 1 and no greater than 3 or one of $R^3$ and $R^4$ represents an alkyl group having a carbon number of at least 1 and no greater than 3 while the other of $R^3$ and $R^4$ represents an aryl group having a carbon number of at least 6 and no greater than 14.

Preferable examples of the repeating unit (1) include repeating units represented by chemical formulas (1-1), (1-2), (1-3), and (1-4) shown below.

(1-1)

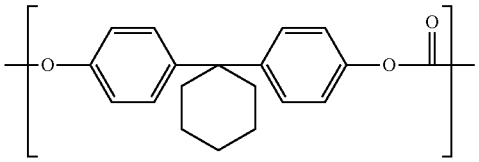

(1-2)

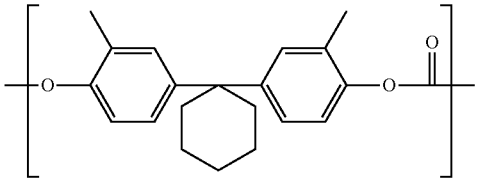

(1-3)

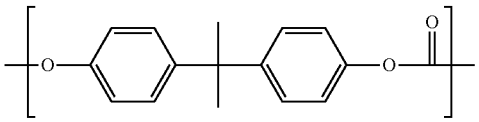

(1-4)

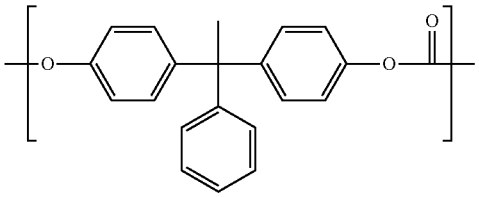

A rate of the number of the repeating units (1) to a total number of repeating units included in the polycarbonate resin (10) is preferably at least 10% and no greater than 95%, more preferably at least 30% and no greater than 85%, and further preferably at least 50% and no greater than 70%.

In general formula (2), the alkyl group having a carbon number of at least 1 and no greater than 3 represented by either or both $R^5$ and $R^6$ is preferably a methyl group or an ethyl group, and more preferably a methyl group. The alkyl group having a carbon number of at least 1 and no greater than 3 represented by either or both $R^5$ and $R^6$ may be substituted by a substituent, and may be substituted by for example a halogen atom.

In general formula (2), $R^5$ and $R^6$ each preferably represent a hydrogen atom or a methyl group. Note that $R^5$ and $R^6$ in general formula (2) are preferably the same as each other.

In general formula (2), W preferably represents a single bond or —O—.

Preferable examples of the repeating unit (2) include repeating units represented by chemical formulas (2-1), (2-2), (2-3), and (2-4) shown below.

(2-1)

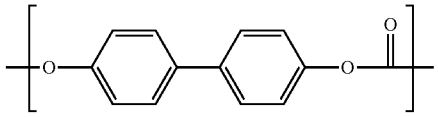

(2-2)

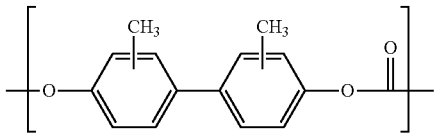

(2-3)

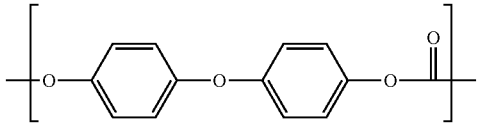

(2-4)

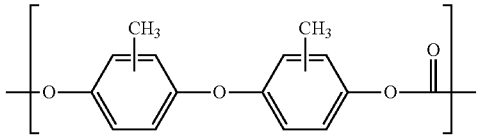

The repeating units represented by chemical formulas (2-2) and (2-4) are preferably repeating units represented by chemical formulas (2-2A) and (2-4A) shown below, respectively.

(2-2A)

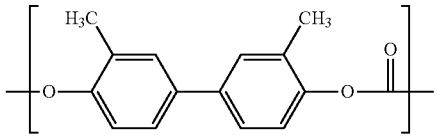

(2-4A)

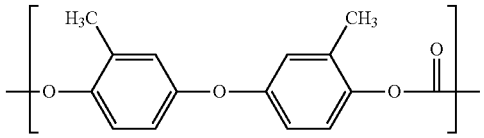

A rate of the number of the repeating units (2) to the total number of the repeating units included in the polycarbonate resin (10) is preferably at least 5% and no greater than 90%, more preferably at least 15% and no greater than 70%, and further preferably at least 30% and no greater than 50%.

The following lists preferable examples of the polycarbonate resin (10):

a first polycarbonate resin including the repeating unit represented by chemical formula (1-1) and the repeating unit represented by chemical formula (2-1);

a second polycarbonate resin including the repeating unit represented by chemical formula (1-2) and the repeating unit represented by chemical formula (2-1);

a third polycarbonate resin including the repeating unit represented by chemical formula (1-3) and the repeating unit represented by chemical formula (2-1);

a fourth polycarbonate resin including the repeating unit represented by chemical formula (1-4) and the repeating unit represented by chemical formula (2-2);

a fifth polycarbonate resin including the repeating unit represented by chemical formula (1-1) and the repeating unit represented by chemical formula (2-3);

a sixth polycarbonate resin including the repeating unit represented by chemical formula (1-2) and the repeating unit represented by chemical formula (2-3);

a seventh polycarbonate resin including the repeating unit represented by chemical formula (1-2) and the repeating unit represented by chemical formula (2-4); and an eighth polycarbonate resin including the repeating unit represented by chemical formula (1-1) and the repeating unit represented by chemical formula (2-2).

The polycarbonate resin (10) may include one or more types of the repeating units (1). The polycarbonate resin (10) may include one or more types of the repeating units (2). Note that the polycarbonate resin (10) preferably includes the repeating unit (1) and the repeating unit (2) only but may further include another repeating unit. A rate of the number of the other repeating units to the total number of the repeating units included in the polycarbonate resin (10) is preferably no greater than 30%, more preferably no greater than 10%, and further preferably no greater than 1%.

The polycarbonate resin (10) preferably has a viscosity average molecular weight of at least 25,000 and no greater than 60,000, and more preferably at least 35,000 and no greater than 53,000. When the polycarbonate resin (10) has a viscosity average molecular weight of at least 25,000, strength of the photosensitive layer tends to increase. When the polycarbonate resin (10) has a viscosity average molecular weight of no greater than 60,000, the polycarbonate resin (10) tends to readily dissolve in a solvent for photosensitive layer formation, thereby facilitating formation of the photosensitive layer.

A content of the polycarbonate resin (10) is preferably at least 70% by mass relative to a mass of the binder resin, more preferably at least 90% by mass, and further preferably at least 99% by mass. A content of the polycarbonate resin (10) is preferably at least 15% by mass and no greater than 60% by mass relative to a mass of the photosensitive layer.

(Hole Transport Material)

Examples of hole transport materials include triphenylamine derivatives, diamine derivatives (for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenanthrylenediamine derivative, and di(aminophenylethenyl)benzene derivative), oxadiazole-based compounds (for example, 2,5-di(4-methylaminophenyl)-1,3,4-oxadiazole), styryl-based compounds (for example, 9-(4-diethylaminostyryl)anthracene), carbazole-based compounds (for example, polyvinyl carbazole), organic polysilane compounds, pyrazoline-based compounds (for example, 1-phenyl-3-(p-dimethylaminophenyl) pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds. The photosensitive layer may contain only one hole transport material or two or more hole transport materials.

In order to further inhibit an image defect resulting from exposure memory and an image defect resulting from a scratch or filming and further improve sensitivity stability, the hole transport material preferably includes at least one of compounds represented by general formulas (11) to (18) shown below. In the following description, the compounds represented by general formulas (11) to (18) may be referred to as compounds (11) to (18), respectively.

The following describes the compound (11). In general formula (11), $Q^1$, $Q^2$, $Q^3$, and $Q^4$ each represent, independently of one another, an alkyl group having a carbon number of at least 1 and no greater than 6. Furthermore, $b_1$, $b_2$, $b_3$, and $b_4$ each represent, independently of one another, an integer of at least 0 and no greater than 5. Also, $b_5$ represents 0 or 1.

(11)

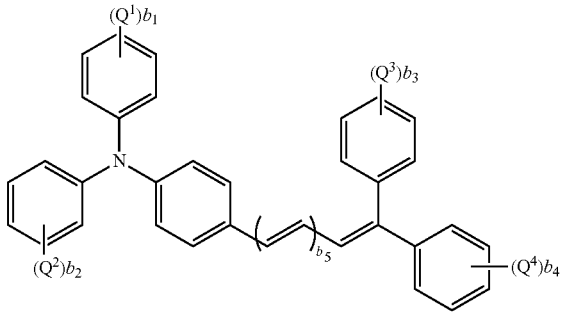

When $b_1$ represents an integer of at least 2 and no greater than 5, plural chemical groups $Q^1$ may be the same as or different from one another. When $b_2$ represents an integer of at least 2 and no greater than 5, plural chemical groups $Q^2$ may be the same as or different from one another. When $b_3$ represents an integer of at least 2 and no greater than 5, plural chemical groups $Q^3$ may be the same as or different from one another. When $b_4$ represents an integer of at least 2 and no greater than 5, plural chemical groups $Q^4$ may be the same as or different from one another.

In general formula (11), the alkyl group having a carbon number of at least 1 and no greater than 6 represented by any of $Q^1$, $Q^2$, $Q^3$, and $Q^4$ is preferably an alkyl group having a carbon number of at least 1 and no greater than 3, and more preferably a methyl group.

In general formula (11), $Q^1$, $Q^2$, $Q^3$, and $Q^4$ preferably each represent, independently of one another, an alkyl group having a carbon number of at least 1 and no greater than 3. Preferably, $b_1$, $b_2$, $b_3$, and $b_4$ each represent, independently of one another, 0 or 1.

Preferable examples of the compound (11) include compounds represented by chemical formulas (11-HT8) and (11-HT9) shown below (also referred to below as compounds (11-HT8) and (11-HT9), respectively).

(11-HT8)

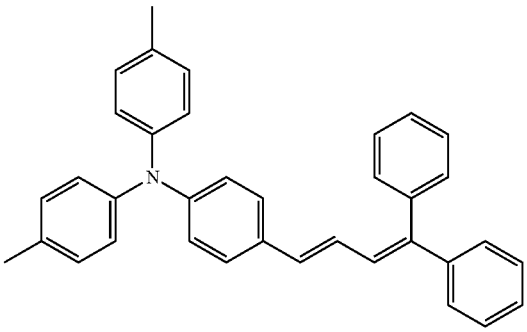

-continued (11-HT9)

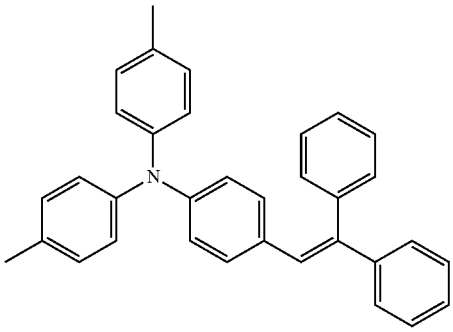

The following describes the compound (12). In general formula (12), $Q^{21}$ and $Q^{28}$ each represent, independently of each other, a hydrogen atom, a phenyl group optionally substituted by an alkyl group having a carbon number of at least 1 and no greater than 6, an alkyl group having a carbon number of at least 1 and no greater than 6, or an alkoxy group having a carbon number of at least 1 and no greater than 6. $Q^{22}$ and $Q^{29}$ each represent, independently of each other, a phenyl group, an alkyl group having a carbon number of at least 1 and no greater than 6, or an alkoxy group having a carbon number of at least 1 and no greater than 6. $Q^{23}$, $Q^{24}$, $Q^{25}$, $Q^{26}$, and $Q^{27}$ each represent, independently of one another, a hydrogen atom, a phenyl group, an alkyl group having a carbon number of at least 1 and no greater than 6, or an alkoxy group having a carbon number of at least 1 and no greater than 6. Adjacent two of $Q^{23}$, $Q^{24}$, $Q^{25}$, $Q^{26}$, and $Q^{27}$ may be bonded together to form a ring (for example, a cycloalkane having a carbon number of at least 5 and no greater than 7, specific examples include cyclopentane, cyclohexane, or cycloheptane). Furthermore, $d_1$ and $d_2$ each represent, independently of each other, an integer of at least 0 and no greater than 2. Furthermore, $d_3$ and $d_4$ each represent, independently of each other, an integer of at least 0 and no greater than 5.

(12)

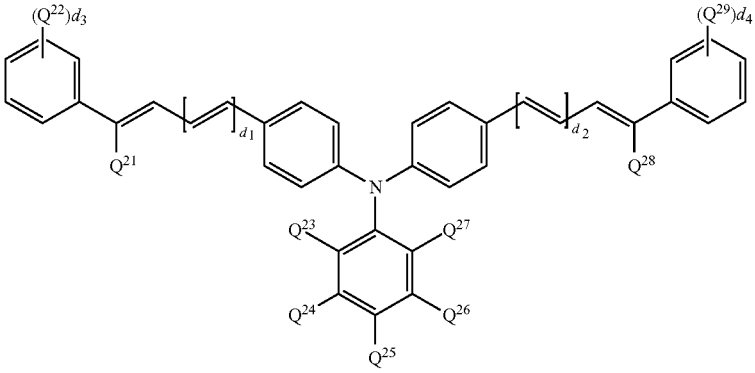

When $d_3$ represents an integer of at least 2 and no greater than 5, plural chemical groups $Q^{22}$ may be the same as or different from one another. When $d_4$ represents an integer of at least 2 and no greater than 5, plural chemical groups $Q^{29}$ may be the same as or different from one another.

In general formula (12), $Q^{21}$ and $Q^{28}$ preferably each represent, independently of each other, a hydrogen atom or a phenyl group optionally substituted by an alkyl group having a carbon number of at least 1 and no greater than 6. $Q^{22}$ and $Q^{29}$ preferably each represent, independently of each other, an alkyl group having a carbon number of at least 1 and no greater than 6. $Q^{23}$, $Q^{24}$, $Q^{25}$, $Q^{26}$, and $Q^{27}$ preferably each represent, independently of one another, a hydrogen atom, an alkyl group having a carbon number of at least 1 and no greater than 6, or an alkoxy group having a carbon number of at least 1 and no greater than 6. Adjacent two of $Q^{23}$, $Q^{24}$, $Q^{25}$, $Q^{26}$, and $Q^{27}$ may be bonded together to form a cycloalkane having a carbon number of at least 5 and no greater than 7. In the above case, a condensation portion between a phenyl group and the cycloalkane having a carbon number of at least 5 and no greater than 7 may have a double bond. Preferably, $d_1$ and $d_2$ each represent, independently of each other, an integer of at least 0 and no greater than 2. Preferably, $d_3$ and $d_4$ each represent, independently of each other, 0 or 1.

The phenyl group optionally substituted by an alkyl group having a carbon number of at least 1 and no greater than 6 represented by either or both $Q^{21}$ and $Q^{28}$ is preferably a phenyl group optionally substituted by an alkyl group having a carbon number of at least 1 and no greater than 3, and more preferably a phenyl group optionally substituted by a methyl group. The alkyl group having a carbon number of at least 1 and no greater than 6 represented by either or both $Q^{22}$ and $Q^{29}$ is preferably an alkyl group having a carbon number of at least 1 and no greater than 3, and more preferably a methyl group. The alkyl group having a carbon number of at least 1 and no greater than 6 represented by any of $Q^{23}$, $Q^{24}$, $Q^{25}$, $Q^{26}$, and $Q^{27}$ is preferably an alkyl group having a carbon number of at least 1 and no greater than 4, more preferably a methyl group, an ethyl group, or an n-butyl group, and further preferably a methyl group. The alkoxy group having a carbon number of at least 1 and no greater than 6 represented by any of $Q^{23}$, $Q^{24}$, $Q^{25}$, $Q^{26}$, and $Q^{27}$ is preferably an alkoxy group having a carbon number of at least 1 and no greater than 3, and more preferably an ethoxy group. Cyclohexane is preferable as the cycloalkane having a carbon number of at least 5 and no greater than 7 and formed through bonding of adjacent two of $Q^{23}$, $Q^{24}$, $Q^{25}$, $Q^{26}$, and $Q^{27}$.

In general formula (12), it is preferable that: $Q^{21}$ and $Q^{28}$ are the same as each other; $Q^{22}$ and $Q^{29}$ are the same as each other; $d_1$ and $d_2$ represent the same integer; and $d_3$ and $d_4$ represent the same integer.

Preferable examples of the compound (12) include compounds represented by chemical formulas (12-HT3), (12-HT4), (12-HT5), (12-HT6), (12-HT10), (12-HT11), (12-HT12), and (12-HT18) shown below (also referred to below as compounds (12-HT3), (12-HT4), (12-HT5), (12-HT6), (12-HT10), (12-HT11), (12-HT12), and (12-HT18), respectively).

(12-HT3)
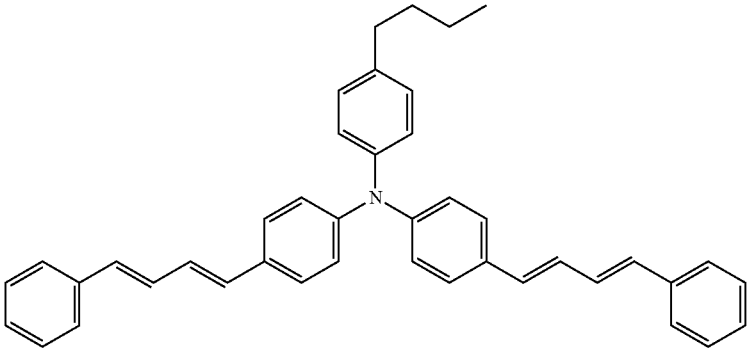
(12-HT4)
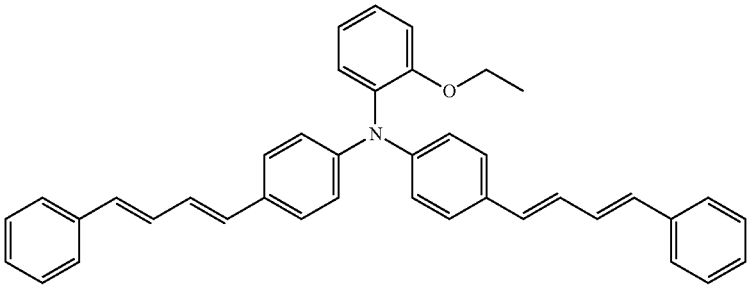
(12-HT5)
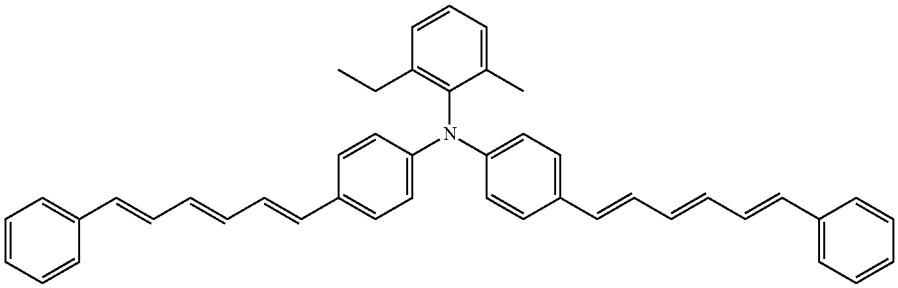
(12-HT6)
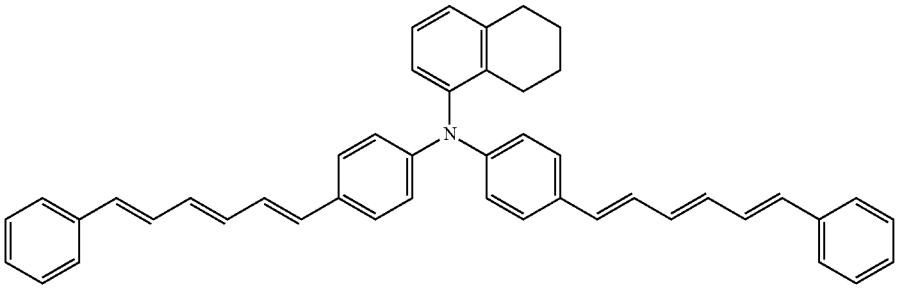
(12-HT10)
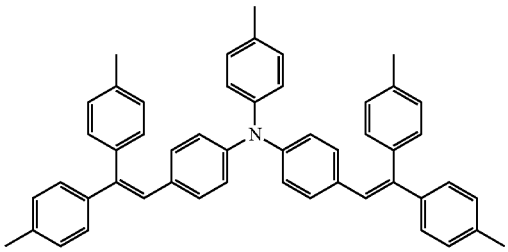
(12-HT11)
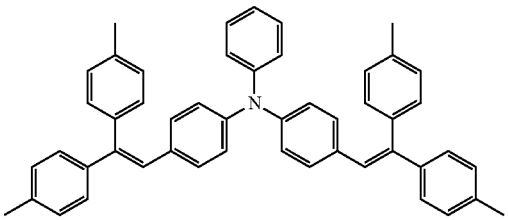

-continued (12-HT12)

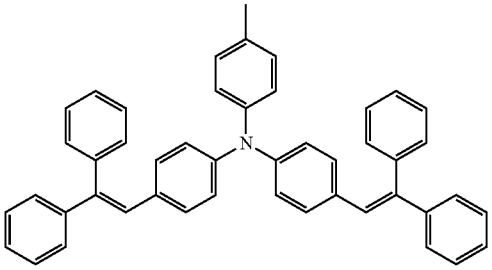

The following describes the compound (13). In general formula (13), $Q^{31}$, $Q^{32}$, $Q^{33}$, and $Q^{34}$ each represent, independently of one another, an alkyl group having a carbon number of at least 1 and no greater than 6 or an alkoxy group having a carbon number of at least 1 and no greater than 6. Furthermore, $e_1$, $e_2$, $e_3$, and $e_4$ each represent, independently of one another, an integer of at least 0 and no greater than 5. Also, $e_5$ represents 2 or 3.

(13)

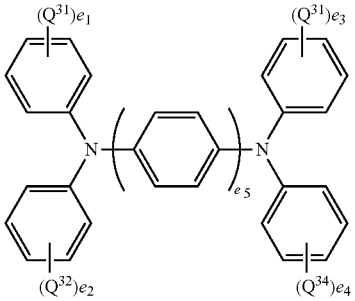

When $e_1$ represents an integer of at least 2 and no greater than 5, plural chemical groups $Q^{31}$ may be the same as or different from one another. When $e_2$ represents an integer of at least 2 and no greater than 5, plural chemical groups $Q^{32}$ may be the same as or different from one another. When $e_3$ represents an integer of at least 2 and no greater than 5, plural chemical groups $Q^{33}$ may be the same as or different from one another. When $e_4$ represents an integer of at least 2 and no greater than 5, plural chemical groups $Q^{34}$ may be the same as or different from one another.

In general formula (13), $Q^{31}$, $Q^{32}$, $Q^{33}$, and $Q^{34}$ preferably each represent, independently of one another, an alkyl group having a carbon number of at least 1 and no greater than 6. The alkyl group having a carbon number of at least 1 and no greater than 6 represented by any of $Q^{31}$, $Q^{32}$, $Q^{33}$, and $Q^{34}$ is preferably an alkyl group having a carbon number of at least 1 and no greater than 3, and more preferably a methyl group. Preferably, $e_1$, $e_2$, $e_3$, and $e_4$ each represent, independently of one another, 0 or 1. Preferably, $e_5$ represents 2 or 3.

Preferable examples of the compound (13) include compounds represented by chemical formulas (13-HT16) and (13-HT17) shown below (also referred to below as compounds (13-HT16) and (13-HT17), respectively).

(12-HT18)

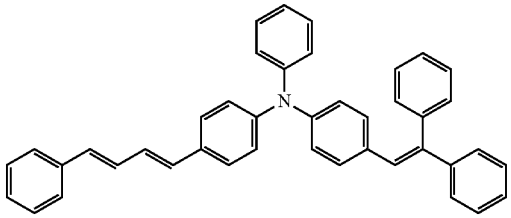

(13-HT16)

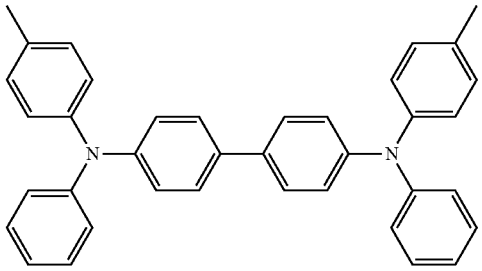

(13-HT17)

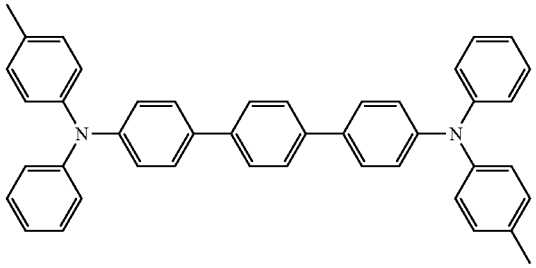

The following describes the compound (14). In general formula (14), $Q^{41}$, $Q^{42}$, $Q^{43}$, $Q^{44}$, $Q^{45}$, and $Q^{46}$ each represent, independently of one another, a hydrogen atom, a phenyl group, an alkyl group having a carbon number of at least 1 and no greater than 6, or an alkoxy group having a carbon number of at least 1 and no greater than 6. $Q^{47}$, $Q^{48}$, $Q^{49}$, and $Q^{50}$ each represent, independently of one another, a phenyl group, an alkyl group having a carbon number of at least 1 and no greater than 6, or an alkoxy group having a carbon number of at least 1 and no greater than 6. Furthermore, $g_1$ and $g_2$ each represent, independently of each other, an integer of at least 0 and no greater than 5. Furthermore, $g_3$ and $g_4$ each represent, independently of each other, an integer of at least 0 and no greater than 4. Also, f represents 0 or 1.

(14)

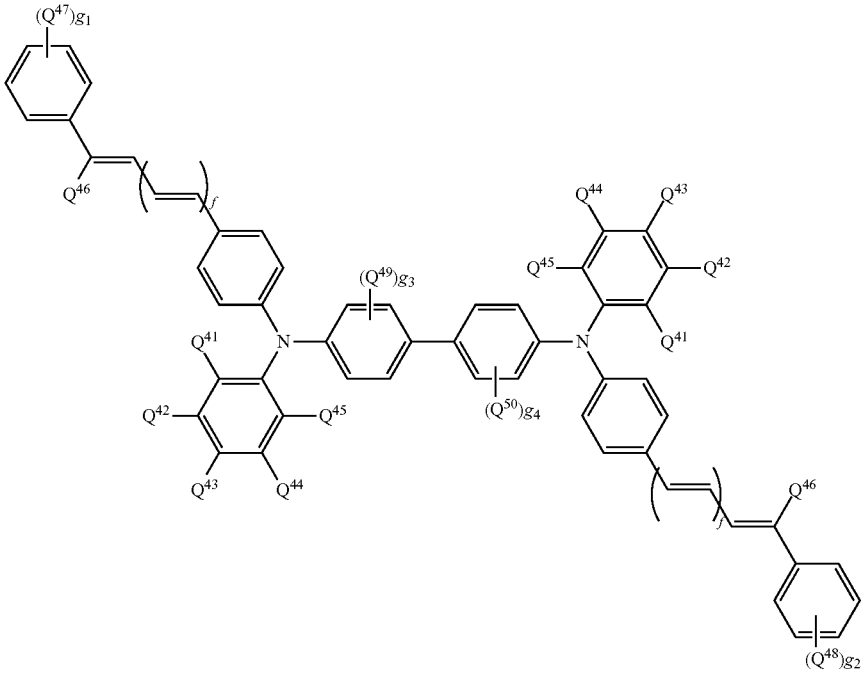

When $g_1$ represents an integer of at least 2 and no greater than 5, plural chemical groups $Q^{47}$ may be the same as or different from one another. When $g_2$ represents an integer of at least 2 and no greater than 5, plural chemical groups $Q^{48}$ may be the same as or different from one another. When $g_3$ represents an integer of at least 2 and no greater than 4, plural chemical groups $Q^{49}$ may be the same as or different from one another. When $g_4$ represents an integer of at least 2 and no greater than 4, plural chemical groups $Q^{50}$ may be the same as or different from one another.

In general formula (14), $Q^{41}$, $Q^{42}$, $Q^{43}$, $Q^{44}$, $Q^{45}$, and $Q^{46}$ preferably each represent, independently of one another, a hydrogen atom or an alkyl group having a carbon number of at least 1 and no greater than 6. Preferably, $g_1$ and $g_2$ each represent 0. Preferably, $g_3$ and $g_4$ each represent 0. Preferably, f represents 0 or 1. The alkyl group having a carbon number of at least 1 and no greater than 6 represented by any of $Q^{41}$, $Q^{42}$, $Q^{43}$, $Q^{44}$, $Q^{45}$, and $Q^{46}$ is preferably an alkyl group having a carbon number of at least 1 and no greater than 3, and more preferably a methyl group or an ethyl group.

Preferable examples of the compound (14) include compounds represented by chemical formulas (14-HT1) and (14-HT2) shown below (also referred to below as compounds (14-HT1) and (14-HT2), respectively).

(14-HT1)

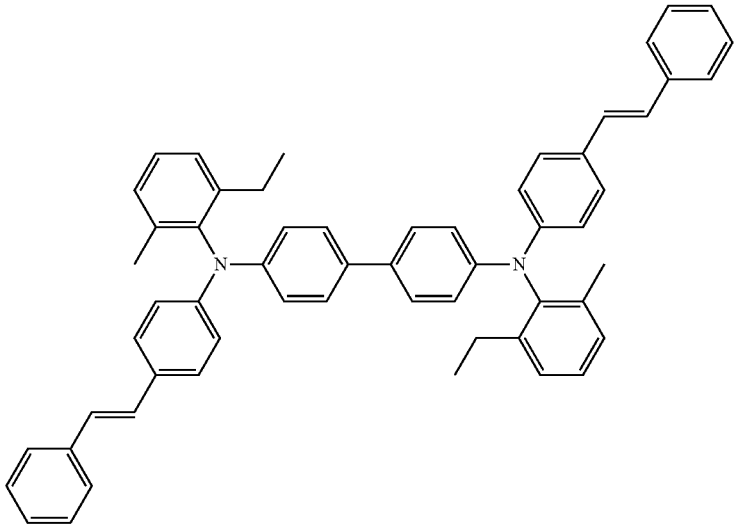

-continued (14-HT2)

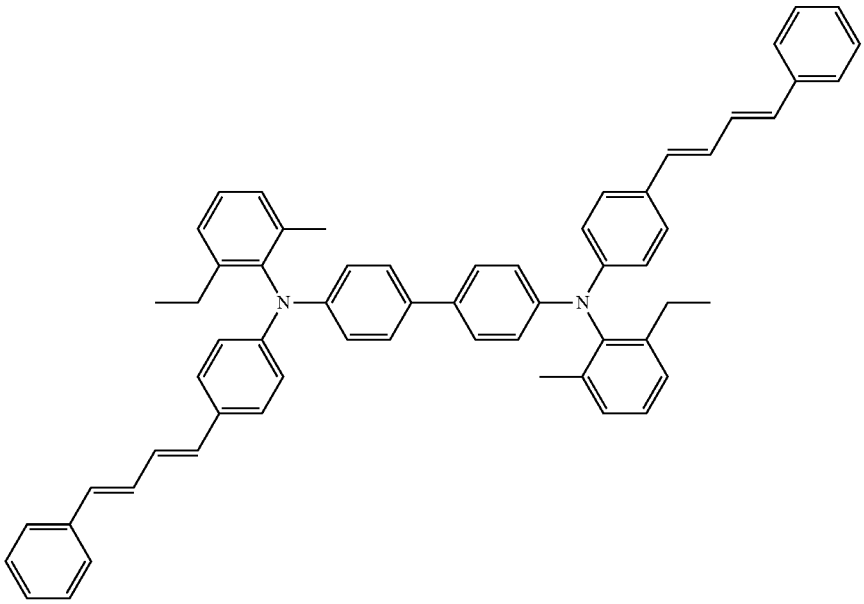

The following describes the compound (15). In general formula (15), $Q^{51}$, $Q^{52}$, $Q^{53}$, $Q^{54}$, $Q^{55}$, and $Q^{56}$ each represent, independently of one another, a phenyl group, an alkenyl group having a carbon number of at least 2 and no greater than 4 and optionally substituted by at least one phenyl group, an alkyl group having a carbon number of at least 1 and no greater than 6, or an alkoxy group having a carbon number of at least 1 and no greater than 6. Furthermore, $h_3$ and $h_6$ each represent, independently of each other, an integer of at least 0 and no greater than 4. Also, $h_1$, $h_2$, $h_4$, and $h_5$ each represent, independently of one another, an integer of at least 0 and no greater than 5.

(15)

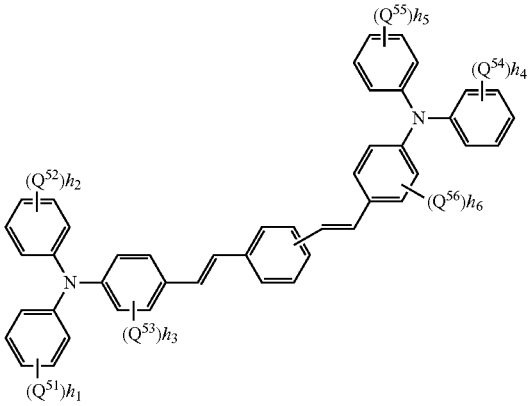

When $h_3$ represents an integer of at least 2 and no greater than 4, plural chemical groups $Q^{53}$ may be the same as or different from one another. When $h_6$ represents an integer of at least 2 and no greater than 4, plural chemical groups $Q^{56}$ may be the same as or different from one another. When $h_1$ represents an integer of at least 2 and no greater than 5, plural chemical groups $Q^{51}$ may be the same as or different from one another. When $h_2$ represents an integer of at least 2 and no greater than 5, plural chemical groups $Q^{52}$ may be the same as or different from one another. When $h_4$ represents an integer of at least 2 and no greater than 5, plural chemical groups $Q^{54}$ may be the same as or different from one another. When $h_5$ represents an integer of at least 2 and no greater than 5, plural chemical groups $Q^{55}$ may be the same as or different from one another.

In general formula (15), $Q^{51}$, $Q^{52}$, $Q^{53}$, $Q^{54}$, $Q^{55}$, and $Q^{56}$ preferably each represent, independently of one another, an alkenyl group having a carbon number of at least 2 and no greater than 4 and optionally substituted by at least one phenyl group or an alkyl group having a carbon number of at least 1 and no greater than 6. Preferably, $h_3$ and $h_6$ each represent 0. Preferably, $h_1$, $h_2$, $h_4$, and $h_5$ each represent, independently of one another, an integer of at least 0 and no greater than 2. The alkenyl group having a carbon number of at least 2 and no greater than 4, optionally substituted by at least one phenyl group, and represented by any of $Q^{51}$, $Q^{52}$, $Q^{53}$, $Q^{54}$, $Q^{55}$, and $Q^{56}$ is preferably an ethenyl group substituted by at least 1 and no greater than 3 phenyl groups, and more preferably a diphenylethenyl group. The alkyl group having a carbon number of at least 1 and no greater than 6 represented by any of $Q^{51}$, $Q^{52}$, $Q^{53}$, $Q^{54}$, $Q^{55}$, and $Q^{56}$ is preferably an alkyl group having a carbon number of at least 1 and no greater than 3, and more preferably a methyl group or an ethyl group.

Preferable examples of the compound (15) include compounds represented by chemical formulas (15-HT13), (15-HT14), and (15-HT15) shown below (also referred to below as compounds (15-HT13), (15-HT14), and (15-HT15), respectively).

(15-HT13)

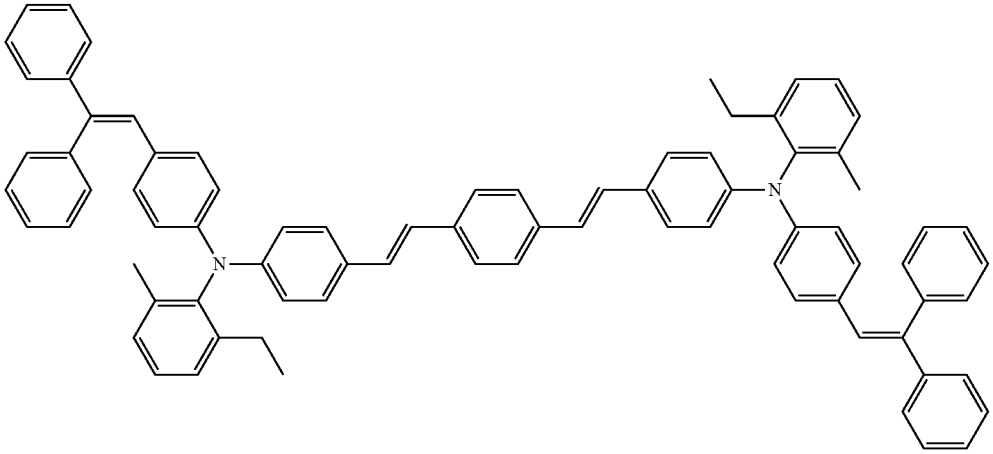

(15-HT14)

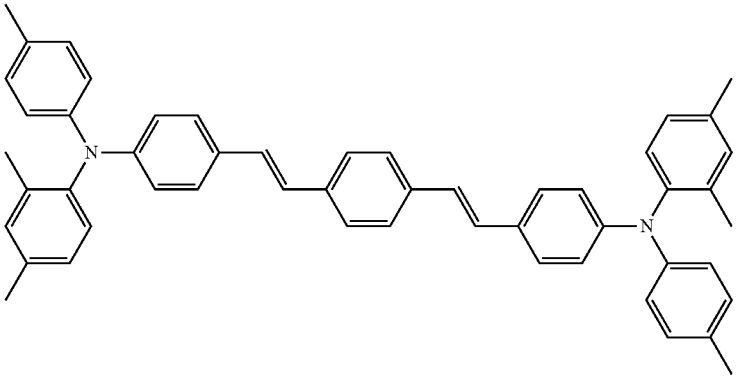

(15-HT15)

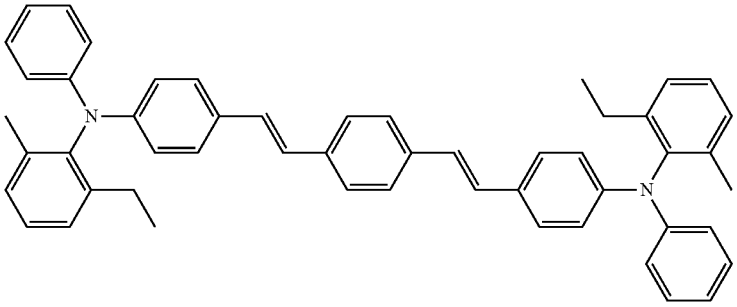

The following describes the compound (16). In general formula (16), $Q^{61}$, $Q^{62}$, and $Q^{63}$ each represent, independently of one another, a phenyl group, an alkyl group having a carbon number of at least 1 and no greater than 6, or an alkoxy group having a carbon number of at least 1 and no greater than 6. Furthermore, $f_1$, $f_2$, and $f_3$ each represent, independently of one another, an integer of at least 0 and no greater than 5. Also, $Q^{64}$, $Q^{65}$, and $Q^{66}$ each represent, independently of one another, a hydrogen atom, a phenyl group optionally substituted by an alkyl group having a carbon number of at least 1 and no greater than 6, an alkyl group having a carbon number of at least 1 and no greater than 6, or an alkoxy group having a carbon number of at least 1 and no greater than 6. Also, $f_4$, $f_5$, and $f_6$ each represent, independently of one another, 0 or 1.

(16)

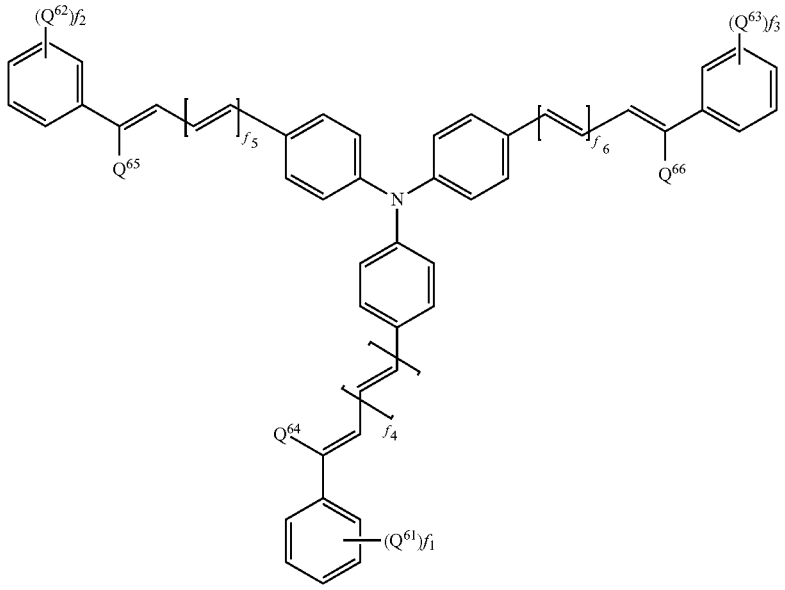

When $f_1$ represents an integer of at least 2 and no greater than 5, plural chemical groups $Q^{61}$ may be the same as or different from one another. When $f_2$ represents an integer of at least 2 and no greater than 5, plural chemical groups $Q^{62}$ may be the same as or different from one another. When $f_3$ represents an integer of at least 2 and no greater than 5, plural chemical groups $Q^{63}$ may be the same as or different from one another.

In general formula (16), $Q^{61}$, $Q^{62}$, and $Q^{63}$ preferably each represent, independently of one another, an alkyl group having a carbon number of at least 1 and no greater than 6. The alkyl group having a carbon number of at least 1 and no greater than 6 represented by any of $Q^{61}$, $Q^{62}$, and $Q^{63}$ is preferably an alkyl group having a carbon number of at least 1 and no greater than 3, and more preferably a methyl group. Preferably, $f_1$, $f_2$, and $f_3$ each represent, independently of one another, 0 or 1. Preferably, $Q^{64}$, $Q^{65}$, and $Q^{66}$ each represent a hydrogen atom. Preferably, $f_4$, $f_5$, and $f_6$ each represent 0.

A preferable example of the compound (16) is a compound represented by chemical formula (16-HT7) shown below (also referred to below as a compound (16-HT7)).

(16-HT7)

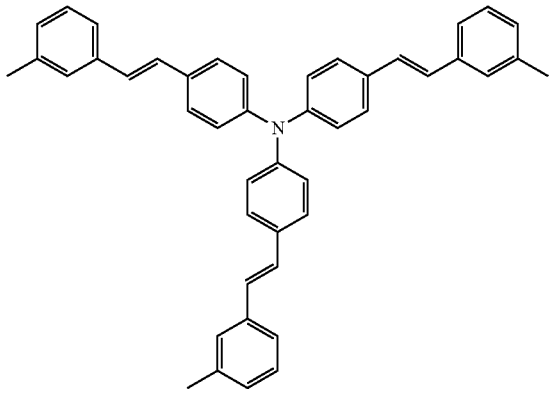

The following describes the compound (17). In general formula (17), $Q^{71}$, $Q^{72}$, $Q^{73}$, $Q^{74}$, $Q^{75}$, and $Q^{76}$ each represent, independently of one another, a halogen atom, an alkyl group having a carbon number of at least 1 and no greater than 6, an alkoxy group having a carbon number of at least 1 and no greater than 6, or an aryl group having a carbon number of at least 6 and no greater than 14. Furthermore, $n_1$, $n_2$, $n_3$, $n_4$, $n_5$, and $n_6$ each represent, independently of one another, an integer of at least 0 and no greater than 5. Also, x represents an integer of at least 1 and no greater than 3. Also, r and s each represent, independently of each other, 0 or 1.

(17)

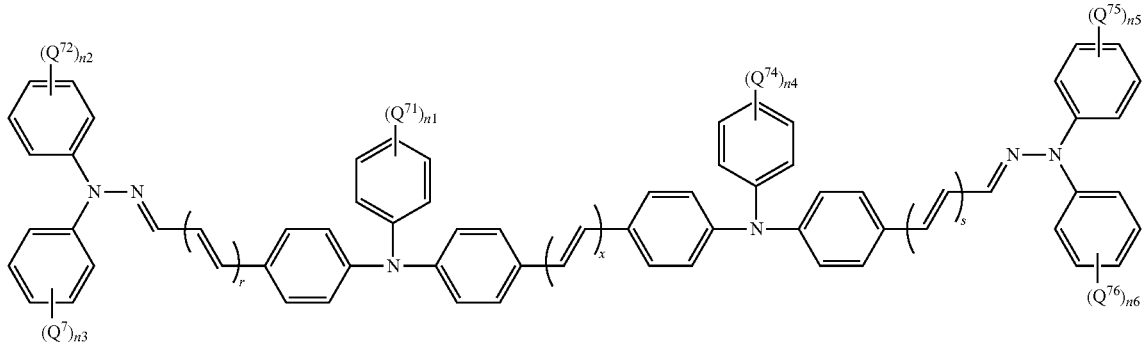

When $n_1$ represents an integer of at least 2 and no greater than 5, plural chemical groups $Q^{71}$ may be the same as or different from one another. When $n_2$ represents an integer of at least 2 and no greater than 5, plural chemical groups $Q^{72}$ may be the same as or different from one another. When $n_3$ represents an integer of at least 2 and no greater than 5, plural chemical groups $Q^{73}$ may be the same as or different from one another. When $n_4$ represents an integer of at least 2 and no greater than 5, plural chemical groups $Q^{74}$ may be the same as or different from one another. When $n_5$ represents an integer of at least 2 and no greater than 5, plural chemical groups $Q^{75}$ may be the same as or different from one another. When $n_6$ represents an integer of at least 2 and no greater than 5, plural chemical groups $Q^{76}$ may be the same as or different from one another.

In general formula (17), $Q^{71}$, $Q^{72}$, $Q^{73}$, $Q^{74}$, $Q^{75}$, and $Q^{76}$ preferably each represent, independently of one another, an alkyl group having a carbon number of at least 1 and no greater than 6. Preferably, $n_1$, $n_2$, $n_3$, $n_4$, $n_5$, and $n_6$ each represent, independently of one another, 0 or 1. Preferably, x represents 2. Preferably, r and s each represent 0. The alkyl group having a carbon number of at least 1 and no greater than 6 represented by any of $Q^{71}$, $Q^{72}$, $Q^{73}$, $Q^{74}$, $Q^{75}$, and $Q^{76}$ is preferably an alkyl group having a carbon number of at least 1 and no greater than 3, and more preferably a methyl group.

A preferable example of the compound (17) is a compound represented by chemical formula (17-HT19) shown below (also referred to below as a compound (17-HT19)).

(17-HT19)

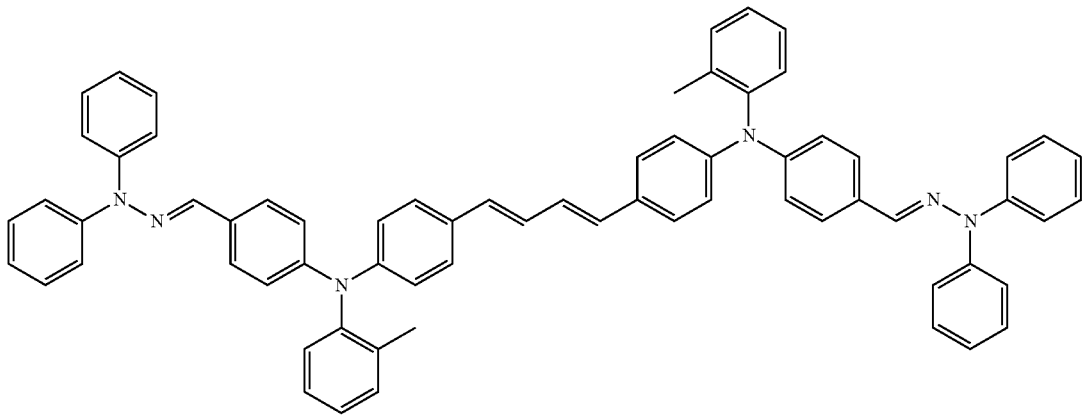

The following describes the compound (18). In general formula (18), $Q^{81}$ and $Q^{82}$ each represent, independently of each other, an alkyl group having a carbon number of at least 1 and no greater than 6 or an aryl group having a carbon number of at least 6 and no greater than 14, with the proviso that at least one of $Q^{81}$ and $Q^{82}$ represents an alkyl group having a carbon number of at least 1 and no greater than 6. $Q^{83}$ represents an alkyl group having a carbon number of at least 1 and no greater than 6, an alkoxy group having a carbon number of at least 1 and no greater than 6, an aralkyl group having a carbon number of at least 7 and no greater than 20, or an aryl group having a carbon number of at least 6 and no greater than 14. Furthermore, m represents an integer of at least 0 and no greater than 5. Also, p represents an integer of at least 0 and no greater than 2.

(18)

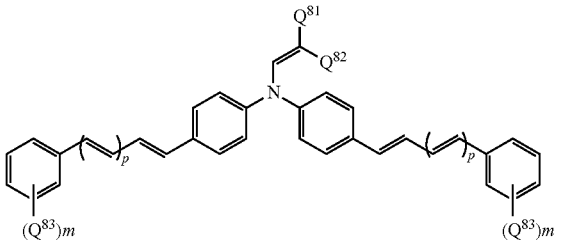

In general formula (18), $Q^{81}$ and $Q^{82}$ each represent an alkyl group having a carbon number of at least 1 and no greater than 6. Alternatively, one of $Q^{81}$ and $Q^{82}$ represents an alkyl group having a carbon number of at least 1 and no greater than 6 while the other of $Q^{81}$ and $Q^{82}$ represents an aryl group having a carbon number of at least 6 and no greater than 14.

In general formula (18), when m represents an integer of at least 2 and no greater than 5, plural chemical groups $Q^{83}$ present in the same aromatic ring may be the same as or different from one another.

In general formula (18), one of $Q^{81}$ and $Q^{83}$ preferably represents an aryl group having a carbon number of at least 6 and no greater than 14. Preferably, m represents 0. Preferably, p represents 1. The alkyl group having a carbon number of at least 1 and no greater than 6 represented by any of $Q^{81}$, $Q^{82}$, and $Q^{83}$ is preferably an alkyl group having a carbon number of at least 1 and no greater than 3, and more preferably a methyl group. The aryl group having a carbon number of at least 6 and no greater than 14 represented by any of $Q^{81}$, $Q^{82}$, and $Q^{83}$ is preferably an aryl group having a carbon number of at least 6 and no greater than 10, and more preferably a phenyl group. The alkoxy group having a carbon number of at least 1 and no greater than 6 represented by $Q^{83}$ in general formula (18) is preferably an alkoxy group having a carbon number of at least 1 and no greater than 3. The aralkyl group having a carbon number of at least 7 and no greater than 20 represented by $Q^{83}$ is preferably an aralkyl group having a carbon number of at least 7 and no greater than 16.

A preferable example of the compound (18) is a compound represented by chemical formula (18-HT21) shown below (also referred to below as a compound (18-HT21)).

(18-HT21)

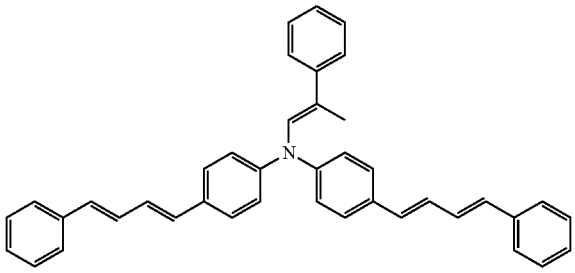

The photosensitive layer may contain only one or two or more of the compounds (11) to (18) as the hole transport material. For example, single use of the compound (12-HT3) or (12-HT10) is possible. Alternatively, either the compound (12-HT3) or (12-HT10) may be used in combination with the compound (14-HT1). Note that the photosensitive layer may further contain a hole transport material other than the compounds (11) to (18) in addition to any of the compounds (11) to (18).

The content of the hole transport material is preferably at least 35% by mass relative to the mass of the photosensitive layer, and more preferably at least 40% by mass. The content of the hole transport material is preferably no greater than 65% by mass relative to the mass of the photosensitive layer, and more preferably no greater than 55% by mass. When the content of the hole transport material is at least 30% by mass relative to the mass of the photosensitive layer, an image defect resulting from a scratch or filming can be further inhibited and sensitivity stability can be further improved. Also, when the content of the hole transport material is no greater than 65% by mass relative to the mass of the photosensitive layer, an image defect resulting from a scratch or filming can be further inhibited and sensitivity stability can be further improved.

A ratio $m_{HTM}/m_{ETM}$ of the mass $m_{HTM}$ of the hole transport material to the mass $m_{ETM}$ of the electron transport material is preferably at least 1.2, and more preferably at least 1.5. The ratio $m_{HTM}/m_{ETM}$ of the mass $m_{HTM}$ of the hole transport material to the mass $m_{ETM}$ of the electron transport material is preferably no greater than 4.0, and more preferably no greater than 3.5. When the ratio $m_{HTM}/m_{ETM}$ is at least 1.2, an image defect resulting from exposure memory can be further inhibited and sensitivity stability can be further improved. Also, when the ratio $m_{HTM}/m_{ETM}$ is no greater than 4.0, an image defect resulting from exposure memory can be further inhibited and sensitivity stability can be further improved. Note that in a situation in which two or more electron transport materials are contained in the photosensitive layer, the mass $m_{ETM}$ of the electron transport material is a total mass of the two or more electron transport materials. Also, in a situation in which two or more hole transport materials are contained in the photosensitive layer, the mass $m_{HTM}$ of the hole transport material is a total mass of the two or more hole transport materials.

A mass of the hole transport material contained in the photosensitive layer is preferably at least 10 parts by mass and no greater than 300 parts by mass relative to 100 parts by mass of the binder resin, more preferably at least 80 parts by mass and no greater than 250 parts by mass, and further preferably at least 120 parts by mass and no greater than 180 parts by mass.

(Electron Transport Material)

Examples of electron transport materials include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azaquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination.

Preferable examples of the electron transport materials listed above include compounds represented by general formulas (21), (22), and (23) shown below (also referred to below as compounds (21), (22), and (23), respectively).

(21)

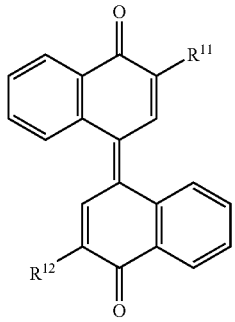

(22)

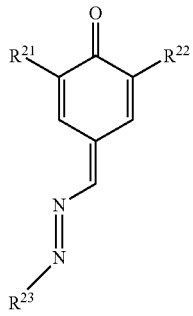

(23)

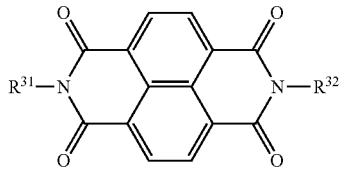

In general formula (21), $R^{11}$ and $R^{12}$ each represent, independently of each other, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20.

In general formula (21), $R^{11}$ and $R^{12}$ preferably each represent, independently of each other, an alkyl group having a carbon number of at least 1 and no greater than 6. The alkyl group having a carbon number of at least 1 and no greater than 6 represented by either or both $R^{11}$ and $R^{12}$ in general formula (21) is preferably an alkyl group having a carbon number of at least 1 and no greater than 5, and more preferably a 1,1-dimethylpropyl group.

A preferable example of the compound (21) is a compound represented by chemical formula (ET1) shown below (also referred to below as a compound (ET1)).

(ET1)

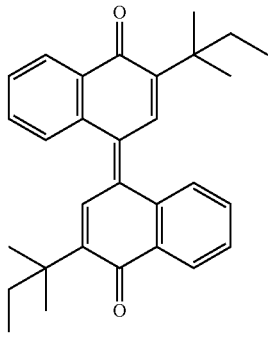

In general formula (22), $R^{21}$, $R^{22}$, and $R^{23}$ each represent, independently of one another, a halogen atom, an alkyl group having a carbon number of at least 1 and no greater than 6, an alkoxy group having a carbon number of at least 1 and no greater than 6, an aryl group having a carbon number of at least 6 and no greater than 14 and optionally substituted by a halogen atom, an aralkyl group having a carbon number of at least 7 and no greater than 20, or a heterocyclic group having at least 5 members and no greater than 14 members.

In general formula (22), $R^{21}$ and $R^{22}$ preferably each represent, independently of each other, an alkyl group having a carbon number of at least 1 and no greater than 6. $R^{23}$ preferably represents an aryl group having a carbon number of at least 6 and no greater than 14 and optionally substituted by a halogen atom. The alkyl group having a carbon number of at least 1 and no greater than 6 represented by either or both $R^{21}$ and $R^{22}$ is preferably an alkyl group having a carbon number of at least 1 and no greater than 4, and more preferably a tert-butyl group. The aryl group having a carbon number of at least 6 and no greater than 14 represented by $R^{23}$ is preferably an aryl group having a carbon number of at least 6 and no greater than 10, and more preferably a phenyl group. The aryl group having a carbon number of at least 6 and no greater than 14 represented by $R^{23}$ may be substituted by a halogen atom. A halogen atom such as above is preferably a fluorine atom or a chlorine atom, and more preferably a chlorine atom. The number of halogen atoms included in the aryl group having a carbon number of at least 6 and no greater than 14 represented by $R^{23}$ is preferably at least 1 and no greater than 3, and more preferably 1.

A preferable example of the compound (22) is a compound represented by chemical formula (ET2) shown below (also referred to below as a compound (ET2)).

(ET2)

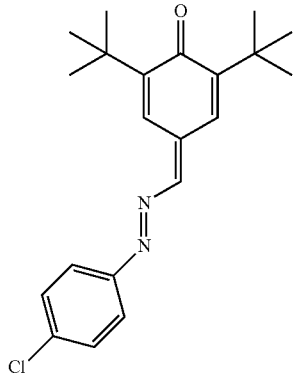

In general formula (23), $R^{31}$ and $R^{32}$ each represent, independently of each other, a halogen atom, an amino group, an alkyl group having a carbon number of at least 1 and no greater than 6, an alkoxy group having a carbon number of at least 1 and no greater than 6, or an aryl group having a carbon number of at least 6 and no greater than 14 and optionally substituted by a substituent.

In general formula (23), $R^{31}$ and $R^{32}$ preferably each represent, independently of each other, an aryl group having a carbon number of at least 6 and no greater than 14 and optionally substituted by a substituent. The aryl group having a carbon number of at least 6 and no greater than 14 represented by either or both $R^{31}$ and $R^{32}$ is preferably an aryl group having a carbon number of at least 6 and no greater than 10, and more preferably a phenyl group. The aryl group having a carbon number of at least 6 and no greater than 14 represented by either or both $R^{31}$ and $R^{32}$ may be substituted by a substituent. Examples of substituents such as above include a halogen atom, a hydroxyl group, a nitro group, a cyano group, an alkyl group having a carbon number of at least 1 and no greater than 6, an alkoxy group having a carbon number of at least 1 and no greater than 6, and an aryl group having a carbon number of least 6 and no greater than 14. The substituent that the aryl group having a carbon number of at least 6 and no greater than 14 represented by either or both $R^{31}$ and $R^{32}$ has is preferably an alkyl group having a carbon number of at least 1 and no greater than 6, more preferably an alkyl group having a carbon number of at least 1 and no greater than 3, and further preferably a methyl group or an ethyl group. The number of substituents by which the aryl group having a carbon number of at least 6 and no greater than 14 represented by either or both $R^{31}$ and $R^{32}$ is substituted is preferably at least 1 and no greater than 3, more preferably at least 1 and no greater than 2, and further preferably 2.

A preferable example of the compound (23) is a compound represented by chemical formula (ET3) shown below (also referred to below as a compound (ET3)).

(ET3)

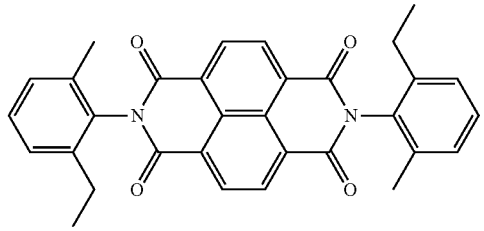

In order to improve sensitivity stability of the photosensitive member, the electron transport material is preferably the compound (21), and more preferably the compound (ET1).

The photosensitive layer may contain one of the compounds (21), (22), and (23) only as the electron transport material. Alternatively, the photosensitive layer may contain two or more of the compounds (21), (22), and (23) as the electron transport material. Furthermore, the photosensitive layer may further contain an electron transport material other than the compounds (21), (22), and (23) as the electron transport material in addition to any of the compounds (21), (22), and (23).

An amount of the electron transport material is preferably at least 20 parts by mass and no greater than 100 parts by mass relative to 100 parts by mass of the binder resin, more preferably at least 40 parts by mass and no greater than 90 parts by mass, and further preferably at least 60 parts by mass and no greater than 90 parts by mass.

In order to further inhibit an image defect resulting from exposure memory and an image defect resulting from a scratch or filming and further improve sensitivity stability, the mass $m_{HTM}$ of the hole transport material, the mass $m_{ETM}$ of the electron transport material, and a mass $m_R$ of the binder resin preferably satisfy the following relational expression (A).

$$[(m_{HTM}+m_{ETM})/m_R]>1.30 \quad (A)$$

More preferably, $(m_{HTM}+m_{ETM})/m_R$ is at least 1.50, and at least 2.00 is further preferable. Preferably, $(m_{HTM}+m_{ETM})/m_R$ is no greater than 4.50. No greater than 3.50 is more preferable, and no greater than 2.50 is further preferable.

(Charge Generating Material)

No particular limitations are placed on the charge generating material other than being a charge generating material that can be used in photosensitive members. Examples of charge generating materials include phthalocyanine-based pigments, perylene-based pigments, bisazo pigments, trisazo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, and amorphous silicon), pyrylium pigments, anthanthrone-based pigments, triphenylmethane-based pigments, threne-based pigments, toluidine-based pigments, pyrazoline-based pigments, and quinacridone-based pigments. Any one charge generating material may be used independently, or any two or more charge generating materials may be used in combination.

Examples of phthalocyanine-based pigments include metal-free phthalocyanines and metal phthalocyanines. Examples of metal phthalocyanines include titanyl phthalocyanine, hydroxygallium phthalocyanine, and chlorogallium phthalocyanine. Titanyl phthalocyanine is represented for example by chemical formula (CG1) shown below. Metal-free phthalocyanine is represented for example by chemical formula (CG2) shown below.

(CG1)

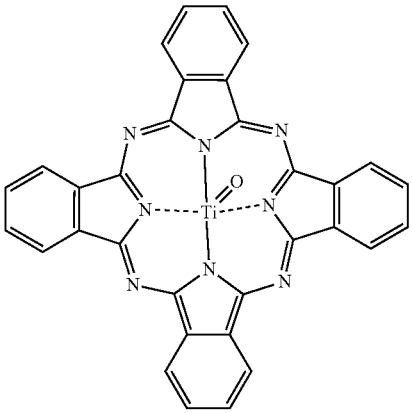

(CG2)

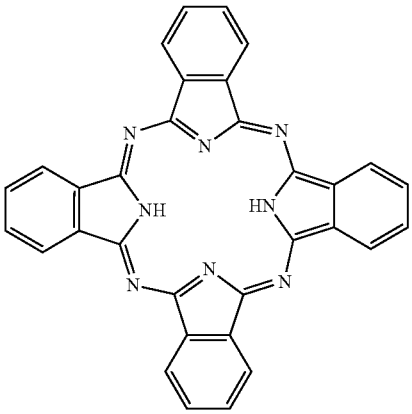

The phthalocyanine-based pigments may be crystalline or non-crystalline. No particular limitations are placed on crystal structure (for example, α-form, β-form, Y-form, V-form, or II-form) of the phthalocyanine-based pigments, and phthalocyanine-based pigments having various different crystal structures may be used. An example of crystalline metal-free phthalocyanines is metal-free phthalocyanine having an X-form crystal structure (also referred to below as X-form metal-free phthalocyanine). Examples of crystalline titanyl phthalocyanines include titanyl phthalocyanines having α-form, β-form, and Y-form crystal structures (also referred to below as α-form, β-form, and Y-form titanyl phthalocyanines, respectively).

In for example digital optical image forming apparatuses (for example, laser beam printers and facsimile machines each employing a semiconductor laser or the like as a light source), a photosensitive member that is sensitive to a wavelength range of 700 nm or longer is preferably used. As the charge generating material, a phthalocyanine-based pigment is preferable in terms of its high quantum yield in a wavelength range of 700 nm or longer. Metal-free phthalocyanine or titanyl phthalocyanine is more preferable. X-form metal-free phthalocyanine or Y-form titanyl phthalocyanine is further preferable. Y-form titanyl phthalocyanine is particularly preferable.

Y-form titanyl phthalocyanine exhibits a main peak for example at a Bragg angle (2θ±0.2°) of 27.2° in a CuKα characteristic X-ray diffraction spectrum. The term main peak refers to a peak having a highest or second highest intensity within a range of Bragg angles (2θ±0.2°) from 3° to 40° in a CuKα characteristic X-ray diffraction spectrum.

The following describes an example of a method for measuring a CuKα characteristic X-ray diffraction spectrum. A sample (titanyl phthalocyanine) is loaded into a sample holder of an X-ray diffraction spectrometer (for example, "RINT (registered Japanese trademark) 1100", product of Rigaku Corporation), and an X-ray diffraction spectrum is measured using a Cu X-ray tube, a tube voltage of 40 kV, a tube current of 30 mA, and X-rays characteristic of CuKα having a wavelength of 1.542 Å. The measurement range (2θ) is for example from 3° to 40° (start angle: 3°, stop angle: 40°), and the scanning speed is for example 10°/minute.

For a photosensitive member in an image forming apparatus that uses a short-wavelength laser light source (for example, a laser light source having a wavelength of at least 350 nm and no greater than 550 nm), an anthanthrone-based pigment is preferably used as the charge generating material.

An amount of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 5 parts by mass.

(Additive)

Examples of additives include antidegradants (for example, antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of antioxidants include hindered phenols (for example, di(tert-butyl)p-cresol), hindered amine, paraphenylenediamine, arylalkane, hydroquinone, spirochromane, spiroindanone, and their derivatives as well as organosulfur compounds and organophosphorous compounds.

(Combinations of Components)

Preferable examples of combinations of the hole transport material and the polycarbonate resin (10) in the photosensitive layer include combinations (j-1) to (j-27) shown in Table 1. Preferable examples of combinations of the hole transport material, the electron transport material, and the polycarbonate resin (10) in the photosensitive layer include combinations (k-1) to (k-29) shown in Table 2. Note that under "Hole transport material" in Tables 1 and 2, "12-HT3/14-HT1" indicates combinational use of the compounds (12-HT3) and (14-HT1) and "14-HT1/12-HT10" indicates combinational use of the compounds (14-HT1) and (12-HT10).

TABLE 1

| Combination | Hole transport material | Polycarbonate resin (10) |
|---|---|---|
| j-1 | 14-HT1 | First polycarbonate resin |
| j-2 | 14-HT2 | First polycarbonate resin |
| j-3 | 12-HT3/14-HT1 | First polycarbonate resin |
| j-4 | 12-HT4 | First polycarbonate resin |
| j-5 | 12-HT5 | First polycarbonate resin |
| j-6 | 12-HT6 | First polycarbonate resin |
| j-7 | 16-HT7 | First polycarbonate resin |
| j-8 | 11-HT8 | First polycarbonate resin |
| j-9 | 11-HT9 | First polycarbonate resin |
| j-10 | 14-HT1/12-HT10 | First polycarbonate resin |

TABLE 1-continued

| Combination | Hole transport material | Polycarbonate resin (10) |
|---|---|---|
| j-11 | 12-HT11 | First polycarbonate resin |
| j-12 | 12-HT12 | First polycarbonate resin |
| j-13 | 15-HT13 | First polycarbonate resin |
| j-14 | 15-HT14 | First polycarbonate resin |
| j-15 | 15-HT15 | First polycarbonate resin |
| j-16 | 13-HT16 | First polycarbonate resin |
| j-17 | 13-HT17 | First polycarbonate resin |
| j-18 | 12-HT18 | First polycarbonate resin |
| j-19 | 17-HT19 | First polycarbonate resin |
| j-20 | 14-HT1 | Second polycarbonate resin |
| j-21 | 14-HT1 | Third polycarbonate resin |
| j-22 | 14-HT1 | Fourth polycarbonate resin |
| j-23 | 14-HT1 | Fifth polycarbonate resin |
| j-24 | 14-HT1 | Sixth polycarbonate resin |
| j-25 | 14-HT1 | Seventh polycarbonate resin |
| j-26 | 14-HT1 | Eighth polycarbonate resin |
| j-27 | 18-HT21 | First polycarbonate resin |

TABLE 2

| Combination | Hole transport material | Electron transport material | Polycarbonate resin (10) |
|---|---|---|---|
| k-1 | 14-HT1 | ET1 | First polycarbonate resin |
| k-2 | 14-HT2 | ET1 | First polycarbonate resin |
| k-3 | 12-HT3/14-HT1 | ET1 | First polycarbonate resin |
| k-4 | 12-HT4 | ET1 | First polycarbonate resin |
| k-5 | 12-HT5 | ET1 | First polycarbonate resin |
| k-6 | 12-HT6 | ET1 | First polycarbonate resin |
| k-7 | 16-HT7 | ET1 | First polycarbonate resin |
| k-8 | 11-HT8 | ET1 | First polycarbonate resin |
| k-9 | 11-HT9 | ET1 | First polycarbonate resin |
| k-10 | 14-HT1/12-HT10 | ET1 | First polycarbonate resin |
| k-11 | 12-HT11 | ET1 | First polycarbonate resin |
| k-12 | 12-HT12 | ET1 | First polycarbonate resin |
| k-13 | 15-HT13 | ET1 | First polycarbonate resin |
| k-14 | 15-HT14 | ET1 | First polycarbonate resin |
| k-15 | 15-HT15 | ET1 | First polycarbonate resin |
| k-16 | 13-HT16 | ET1 | First polycarbonate resin |
| k-17 | 13-HT17 | ET1 | First polycarbonate resin |
| k-18 | 12-HT18 | ET1 | First polycarbonate resin |
| k-19 | 17-HT19 | ET1 | First polycarbonate resin |
| k-20 | 14-HT1 | ET2 | First polycarbonate resin |
| k-21 | 14-HT1 | ET3 | First polycarbonate resin |
| k-22 | 14-HT1 | ET1 | Second polycarbonate resin |
| k-23 | 14-HT1 | ET1 | Third polycarbonate resin |
| k-24 | 14-HT1 | ET1 | Fourth polycarbonate resin |
| k-25 | 14-HT1 | ET1 | Fifth polycarbonate resin |
| k-26 | 14-HT1 | ET1 | Sixth polycarbonate resin |
| k-27 | 14-HT1 | ET1 | Seventh polycarbonate resin |
| k-28 | 14-HT1 | ET1 | Eighth polycarbonate resin |
| k-29 | 18-HT21 | ET1 | First polycarbonate resin |

A preferable combination of the charge generating material, the hole transport material, and the polycarbonate resin (10) in the photosensitive layer is a combination of any one of the combinations (j-1) to (j-27) and at least one of X-form metal-free phthalocyanine and Y-form titanyl phthalocyanine. A preferable combination of the charge generating material, the hole transport material, the electron transport material, and the polycarbonate resin (10) in the photosensitive layer is a combination of any one of the combinations (k-1) to (k-29) and at least one of X-form metal-free phthalocyanine and Y-form titanyl phthalocyanine.

<Conductive Substrate>

No particular limitations are placed on the conductive substrate other than being a conductive substrate that can be used in photosensitive members. It is only required that at least a surface portion of the conductive substrate be made from a conductive material. An example of the conductive substrate is a conductive substrate made from a conductive material. Another example of the conductive substrate is a conductive substrate having a coating of a conductive material. Examples of conductive materials include aluminum, iron, copper, tin, platinum, silver, vanadium, molybdenum, chromium, cadmium, titanium, nickel, palladium, indium, stainless steel, and brass. Any one of the conductive materials listed above may be used independently, or any two or more of the conductive materials listed above may be used (for example, as an alloy) in combination. Among the conductive materials listed above, aluminum or an aluminum alloy is preferable in terms of favorable charge mobility from the photosensitive layer to the conductive substrate.

The shape of the conductive substrate is selected appropriately according to the configuration of an image forming apparatus to which the conductive substrate is applied. The conductive substrate is for example in a shape of a sheet or a drum. Furthermore, the thickness of the conductive substrate is appropriately selected according to the shape of the conductive substrate.

<Intermediate Layer>

The intermediate layer (undercoat layer) for example contains inorganic particles and a resin for intermediate layer use (intermediate layer resin). Presence of the intermediate layer is thought to enable smooth flow of current generated during exposure of the photosensitive member to light and inhibit increase in resistance, while also maintaining insulation to a sufficient degree to inhibit leakage current from occurring.

Examples of inorganic particles include particles of metals (for example, aluminum, iron, and copper), particles of metal oxides (for example, titanium oxide, alumina, zirconium oxide, tin oxide, and zinc oxide), and particles of non-metal oxides (for example, silica). Any one of the above-listed types of inorganic particles may be used independently, or any two or more of the above-listed types of inorganic particles may be used in combination.

No particular limitations are placed on the intermediate layer resin other than being a resin that can be used for intermediate layer formation. The intermediate layer may contain an additive. Examples of additives that may be contained in the intermediate layer are the same as the examples of the additives that may be contained in the photosensitive layer.

<Photosensitive Member Production Method>

The photosensitive member is produced for example by the following method. The photosensitive member is produced by applying an application liquid for photosensitive layer formation onto the conductive substrate and drying the application liquid thereon. The application liquid for photosensitive layer formation is prepared by dissolving or dispersing in a solvent the charge generating material, the electron transport material, the binder resin, the hole transport material, and a component added as needed (for example, an additive).

No particular limitations are placed on the solvent contained in the application liquid for photosensitive layer formation so long as each component contained in the application liquid can be dissolved or dispersed therein. Examples of the solvent include alcohols (for example, methanol, ethanol, isopropanol, and butanol), aliphatic hydrocarbons (for example, n-hexane, octane, and cyclohexane), aromatic hydrocarbons (for example, benzene, toluene, and xylene), halogenated hydrocarbons (for example, dichloromethane, dichloroethane, carbon tetrachloride, and chlorobenzene), ethers (for example, dimethyl ether, diethyl ether, tetrahydrofuran, ethylene glycol dimethyl ether, diethylene glycol dimethyl ether, and propylene glycol monomethyl ether), ketones (for example, acetone, methyl ethyl ketone, and cyclohexanone), esters (for example, ethyl acetate and methyl acetate), dimethyl formaldehyde, dimethyl formamide, and dimethyl sulfoxide. Any one of the solvents listed above may be used independently, or any two or more of the solvents listed above may be used in combination. In order to improve workability in photosensitive member production, a non-halogen solvent (solvent other than halogenated hydrocarbons) is preferably used as the solvent.

The application liquid for photosensitive layer formation is prepared by mixing the components and dispersing the components in the solvent. Mixing or dispersion can for example be performed using a bead mill, a roll mill, a ball mill, an attritor, a paint shaker, or an ultrasonic disperser.

The application liquid for photosensitive layer formation may for example further contain a surfactant in order to improve dispersibility of the components.

No particular limitations are placed on a method by which the application liquid for photosensitive layer formation is applied so long as the method enables uniform application of an application liquid onto a conductive substrate. Examples of application methods include blade coating, dip coating, spray coating, spin coating, and bar coating.

No particular limitations are placed on a method by which the application liquid for photosensitive layer formation is dried so long as the method enables evaporation of a solvent contained in an application liquid. One specific example of the method for drying involves thermal treatment (hot-air drying) using a high-temperature dryer or a reduced-pressure dryer. The temperature of thermal treatment is for example at least 40° C. and no greater than 150° C. A time for thermal treatment is for example at least 3 minutes and no greater than 120 minutes.

Note that the photosensitive member production method may further include either or both intermediate layer formation and protective layer formation. A known method is appropriately selected for each of the intermediate layer formation and the protective layer formation.

<Second Embodiment: Image Forming Apparatus >

The following describes an image forming apparatus according to a second embodiment. The image forming apparatus according to the second embodiment includes the photosensitive member according to the first embodiment. The following describes an aspect of the image forming apparatus according to the second embodiment using a tandem color image forming apparatus that adopts a direct transfer process with reference to FIG. 3.

Figure 3:
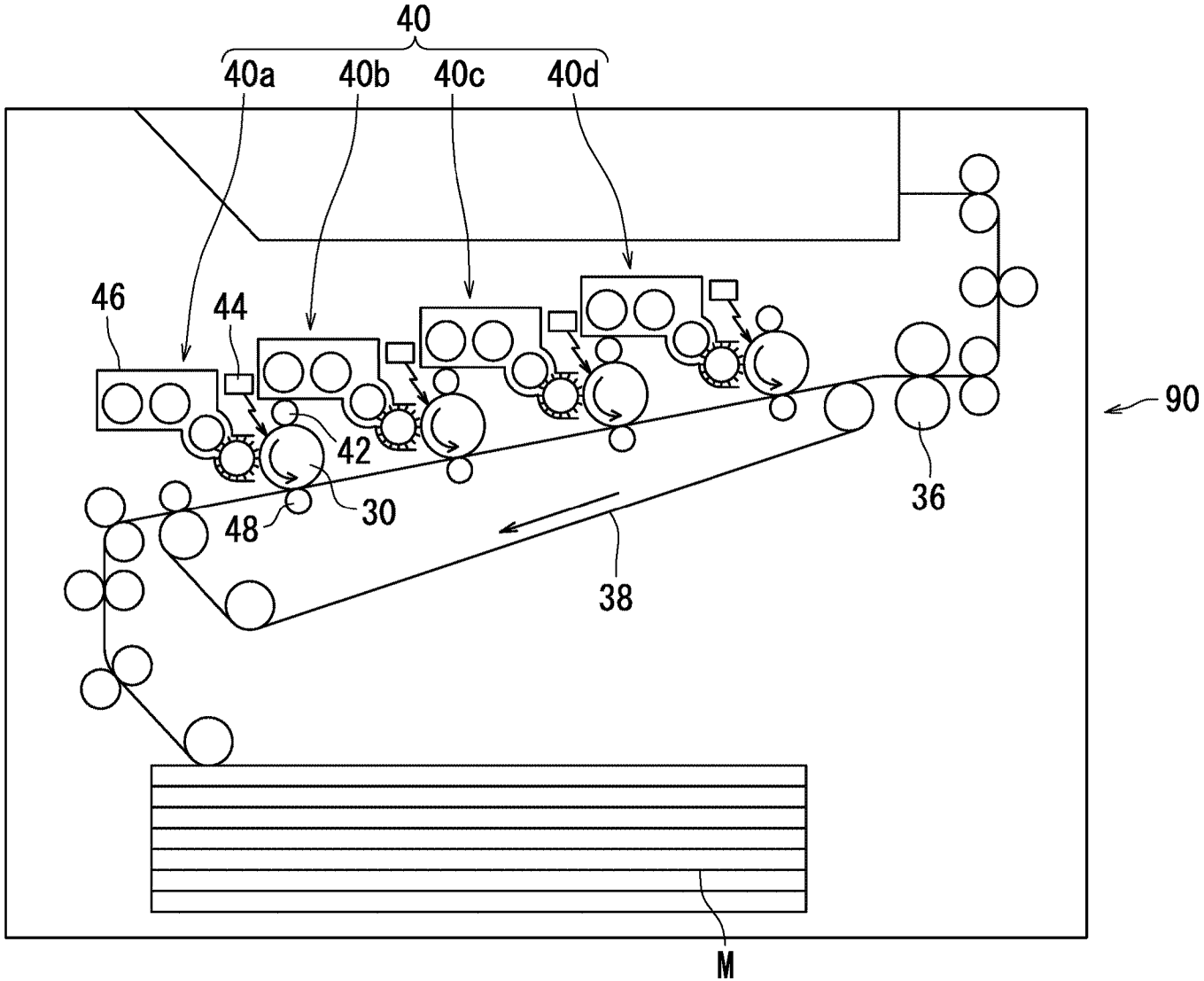
FIG. 3 is a diagram illustrating an example of an image forming apparatus according to a second embodiment of the present disclosure.

An image forming apparatus 90 illustrated in FIG. 3 includes image forming units 40*a*, 40*b*, 40*c*, and 40*d*, a transfer belt 38, and a fixing section 36. In the following description, each of the image forming units 40*a*, 40*b*, 40*c*, and 40*d* may be referred to simply as an image forming unit 40 where it is not necessary to distinguish these units from one another.

Each of the image forming units 40 includes an image bearing member 30, a charger 42, a light exposure section 44, a developing section 46, and a transfer section 48. The image bearing member 30 is the photosensitive member 1 according to the first embodiment. The image bearing member 30 is disposed at a central position in the image forming unit 40. The image bearing member 30 is rotatable in an arrow direction (in a counterclockwise direction). The charger 42, the light exposure section 44, the developing section 46, and the transfer section 48 are disposed around the image bearing member 30 in the stated order from upstream in a rotational direction of the image bearing member 30 starting from the charger 42 as a reference. The image forming unit 40 may further include either or both a cleaner (not illustrated, specifically, a blade cleaner) and a static eliminator (not illustrated). Note that the image forming unit 40 may not include a cleaning blade. That is, the image forming apparatus 90 can adopt a process without blade cleaning.

Toner images in different colors (for example, four colors of black, cyan, magenta, and yellow) are consecutively superimposed on a recording medium M placed on the transfer belt 38 using the image forming units 40*a* to 40*d*.

The charger 42 charges a surface (specifically, a circumferential surface) of the image bearing member 30. The charger 42 has a positive charging polarity. That is, the charger 42 positively charges the surface of the image bearing member 30.

The charger 42 is a charging roller, for example. The charging roller charges the surface of the image bearing member 30 while in contact with the surface of the image bearing member 30. The image forming apparatus 90 adopts a contact charging process. An example of a charger that adopts the contact charging process other than the charging roller is a charging brush. Note that the charger may adopt a non-contact charging process. Examples of chargers that adopt the non-contact charging process include a scorotron charger and a scorotron charger.

The light exposure section 44 exposes the charged surface of the image bearing member 30 to light. As a result of light exposure, an electrostatic latent image is formed on the surface of the image bearing member 30. The electrostatic latent image is formed based on image data input to the image forming apparatus 90.

The developing section 46 supplies toner to the surface of the image bearing member 30. Through toner supply, the developing section 46 develops the electrostatic latent image into a toner image. Thus, the image bearing member 30 bears the toner image. A developer used herein may be a one-component developer or a two-component developer. In a situation in which the developer is a one-component developer, the developing section 46 supplies toner, which is the one-component developer, to the electrostatic latent image formed on the surface of the image bearing member 30. In a situation in which the developer is a two-component developer, the developing section 46 supplies toner among the toner and a carrier included in the two-component developer to the electrostatic latent image formed on the surface of the image bearing member 30.

A time from light exposure of a specific location in the surface of the image bearing member 30 by the light exposure section 44 to development by the developing section 46 (also referred to below as a process time between exposure and development) is preferably no greater than 100 milliseconds. The process time between exposure and development specifically refers to a time from a start of exposure of the specific location in the surface of the image bearing member 30 to light emitted by the light exposure section 44 to a start of toner supply to the specific location by the developing section 46. The specific location in the surface of the image bearing member 30 is for example one point in a region of the circumferential surface of the image bearing member 30 on which light exposure is performed. The process time between exposure and development corresponds to a peripheral speed of the image bearing member 30.

Typically, when the process time between exposure and development is no greater than 100 milliseconds, the peripheral speed of an image bearing member is high and charges tend to remain in a photosensitive layer of an image bearing member. Therefore, an image defect resulting from exposure memory tends to occur. However, the image forming apparatus 90 includes the photosensitive member 1 according to the first embodiment as the image bearing member 30. As a result of use of the photosensitive member 1, an image defect resulting from exposure memory can be inhibited. Accordingly, even when the process time between exposure and development is no greater than 100 milliseconds, an image defect resulting from exposure memory can be inhibited with use of the image forming apparatus 90 including the photosensitive member 1 as the image bearing member 30.

The process time between exposure and development is preferably greater than 0 milliseconds and no greater than 100 milliseconds, more preferably at least 50 milliseconds and no greater than 90 milliseconds, and further preferably at least 65 milliseconds and no greater than 70 milliseconds.

The transfer belt 38 conveys the recording medium M to a location between the image bearing member 30 and the transfer section 48. The transfer belt 38 is an endless belt. The transfer belt 38 circulates in an arrow direction (in a clockwise direction).

The transfer section 48 transfers the toner image developed by the developing section 46 from the surface of the image bearing member 30 to a transfer target. The transfer target is the recording medium M. An example of the transfer section 48 is a transfer roller.

A region of the surface of the image bearing member 30 from which the toner image has been transferred to the recording medium M, which is the transfer target, by the transfer section 48 is re-charged by the charger 42 without static elimination performed. That is, the image forming apparatus 90 can adopt a so-called process without static elimination. Typically, charges tend to remain in a photosensitive layer of an image bearing member in an image forming apparatus that adopts the process without static elimination. Therefore, an image defect resulting from exposure memory tends to occur. However, the image forming apparatus 90 includes the photosensitive member 1 according to the first embodiment as the image bearing member 30. As a result of use of the photosensitive member 1, an image defect resulting from exposure memory can be inhibited. Accordingly, an image defect resulting from exposure memory can be inhibited even in the image forming apparatus 90 adopting the process without static elimination as long as the image forming apparatus 90 includes the photosensitive member 1 as the image bearing member 30.

The fixing section 36 applies heat and/or pressure to the toner images that have been transferred to the recording medium M by the transfer sections 48 and that have not been fixed yet. The fixing section 36 is for example a heating roller and/or a pressure roller. Application of heat and/or pressure to the toner images fixes the toner images to the recording medium M. Through the above, an image is formed on the recording medium M.

An example of the image forming apparatus has been described so far. However, the image forming apparatus is not limited to the above-described image forming apparatus 90. The above-described image forming apparatus 90 is a color image forming apparatus, but the image forming apparatus according to the present embodiment may be a monochrome image forming apparatus. In a configuration in which the image forming apparatus is a monochrome image forming apparatus, the image forming apparatus may include only one image forming unit, for example. The above-described image forming apparatus 90 is a tandem image forming apparatus, but the image forming apparatus according to the present embodiment may for example be a rotary image forming apparatus. The above-described image forming apparatus 90 adopts a direct transfer process, but the image forming apparatus according to the present embodiment may adopt for example an intermediate transfer process. In a configuration in which the image forming apparatus 90 adopts the intermediate transfer process, the transfer section includes a primary transfer section and a secondary transfer section and the transfer target includes a recording medium and a transfer belt.

<Third Embodiment: Process Cartridge>

The following describes a process cartridge according to a third embodiment. The process cartridge according to the third embodiment includes the photosensitive member according to the first embodiment. The following further describes an example of the process cartridge according to the third embodiment with reference again to FIG. 3. The process cartridge is a cartridge for image formation. The process cartridge corresponds to each of the image forming units 40*a* to 40*d*. The process cartridge includes the image bearing member 30. The image bearing member 30 is the photosensitive member 1 according to the first embodiment. The process cartridge may further include at least one selected from the group consisting of the charger 42, the light exposure section 44, the developing section 46, and the transfer section 48 in addition to the photosensitive member 1. The process cartridge may further include either or both a cleaner (not illustrated) and a static eliminator (not illustrated). The process cartridge is designed to be freely attachable to and detachable from the image forming apparatus 90. Accordingly, the process cartridge is easy to handle and can therefore be easily and quickly replaced, together with the photosensitive member 1, when sensitivity characteristics or the like of the photosensitive member 1 deteriorate. The process cartridge according to the third embodiment has been described with reference to FIG. 3.

EXAMPLES

The following provides more specific description of the present disclosure through use of Examples. However, the present disclosure is not in any way limited to the scope of Examples.

<Materials for Photosensitive Layer Formation>

The following electron transport materials, hole transport materials, charge generating materials, and binder resins were prepared as materials for photosensitive layer formation for photosensitive members.

(Electron Transport Material)

The compounds (ET1) to (ET3) described in the first embodiment were prepared as the electron transport materials.

(Hole Transport Material)

The compounds (14-HT1), (14-HT2), (12-HT3), (12-HT4), (12-HT5), (12-HT6), (16-HT7), (11-HT8), (11-HT9), (12-HT10), (12-HT11), (12-HT12), (15-HT13), (15-HT14), (15-HT15), (13-HT16), (13-HT17), (12-HT18), (17-HT19), and (18-HT21) described in the first embodiment were prepared as the hole transport materials. Furthermore, a compound represented by chemical formula (HT20) shown below (also referred to below as a compound (HT20)) was also prepared as the hole transport material.

(HT20)

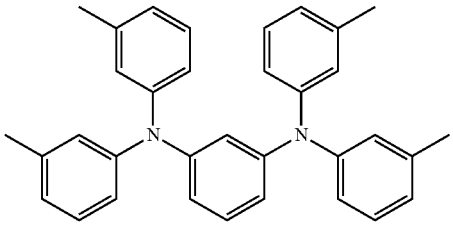

(Charge Generating Material)

Y-form titanyl phthalocyanine and X-form metal-free phthalocyanine were prepared as the charge generating materials. The Y-form titanyl phthalocyanine was a titanyl phthalocyanine having a Y-form crystal structure and represented by chemical formula (CG1) shown in the first embodiment (also referred to below as a compound (CG1)).

(1')

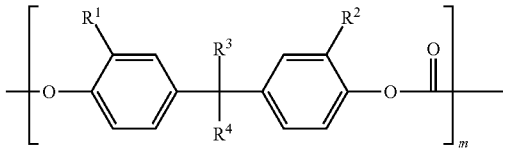

(2')

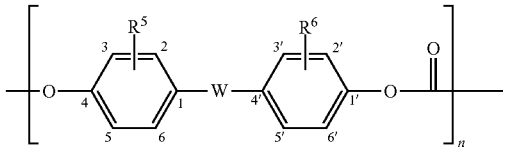

TABLE 3

| Resin | $R^1$ | $R^2$ | $R^3$ | $R^4$ | $R^5$ Type | $R^5$ Substitution site | $R^6$ Type | $R^6$ Substitution site | W | m [%] | n [%] | Viscosity average molecular weight |
|---|---|---|---|---|---|---|---|---|---|---|---|---|
| 1 | H | H | Cyclohexane | | | H | | H | Single bond | 60 | 40 | 40,000 |
| 2 | $CH_3$ | $CH_3$ | Cyclohexane | | | H | | H | Single bond | 60 | 40 | 40,000 |
| 3 | H | H | $CH_3$ | $CH_3$ | | H | | H | Single bond | 60 | 40 | 40,000 |
| 4 | H | H | $CH_3$ | Phenyl group | $CH_3$ | 3 | $CH_3$ | 2' | Single bond | 60 | 40 | 40,000 |
| 5 | H | H | Cyclohexane | | | H | | H | —O— | 60 | 40 | 40,000 |
| 6 | $CH_3$ | $CH_3$ | Cyclohexane | | | H | | H | —O— | 60 | 40 | 40,000 |
| 7 | $CH_3$ | $CH_3$ | Cyclohexane | | $CH_3$ | 3 | $CH_3$ | 2' | —O— | 60 | 40 | 40,000 |
| 8 | H | H | Cyclohexane | | $CH_3$ | 3 | $CH_3$ | 2' | Single bond | 60 | 40 | 40,000 |
| 9 | H | H | Cyclohexane | | $CH_3$ | 3 | $CH_3$ | 2' | Single bond | 80 | 20 | 40,000 |
| 10 | H | H | Cyclohexane | | $CH_3$ | 3 | $CH_3$ | 2' | Single bond | 40 | 60 | 40,000 |
| 11 | H | H | Cyclohexane | | | — | | — | — | 100 | 0 | 40,000 |
| 12 | H | H | $CH_3$ | $C_2H_5$ | | — | | — | — | 100 | 0 | 40,000 |

The X-form metal-free phthalocyanine was a metal-free phthalocyanine having an X-form crystal structure and represented by chemical formula (CG2) shown in the first embodiment (also referred to below as a compound (CG2)).

(Binder Resin)

Resins (1) to (10) that each were a polycarbonate resin of a copolymer including a repeating unit (1) represented by general formula (1') shown below and a repeating unit (2) represented by general formula (2') shown below were prepared as the binder resin. Furthermore, resins (11) and (12) that each were a polycarbonate resin of a homopolymer including only the repeating unit represented by general formula (1') were prepared as the binder resin.

Table 3 shows $R^1$ to $R^6$, W, m, and n in general formulas (1') and (2') and viscosity average molecular weight for each of the resins (1) to (12). Note that m and n respectively represent ratios (%) of the numbers of the repeating units (1) and (2) to a total number of repeating units included in the respective resins (1) to (10). Numerals 1 to 6 along a benzene ring to which $R^5$ is bonded in general formula (2') each represent a substitution site of $R^5$. Numerals 1' to 6' along a benzene ring to which $R^6$ is bonded in general formula (2') each represent a substitution site of $R^6$. In Table 3, "Cyclohexane" under $R^3$ and $R^4$ indicates that $R^3$ and $R^4$ are bonded together to form a divalent group represented by chemical formula (X-2). Also "-" under $R^5$, $R^6$, and W for the resins (11) and (12) indicates that no corresponding part was present due to the absence of the repeating unit (2).

<Photosensitive Member Production>

Photosensitive members (A-1) to (A-36) and (B-1) to (B-5) were produced using the materials for photosensitive layer formation.

(Production of Photosensitive Member (A-1))

A container was charged with 3 parts by mass of the compound (CG1) as the charge generating material, 150 parts by mass of the compound (14-HT1) as the hole transport material, 75 parts by mass of the compound (ET1) as the electron transport material, 100 parts by mass of the resin (1) as the binder resin, and 800 parts by mass of tetrahydrofuran as a solvent. The container contents were mixed for 50 hours using a ball mill in order to disperse the materials in the solvent. Through the above, an application liquid for photosensitive layer formation was obtained. The application liquid for photosensitive layer formation was applied onto a conductive substrate (drum-shaped aluminum support, diameter: 30 mm, entire length: 247.5 mm) by dip coating. After the application, the application liquid for photosensitive layer formation was dried at 120° C. for 60 minutes. Through the above, a photosensitive layer (film thickness: 28 μm) of a single layer was formed on the conductive substrate. The photosensitive member (A-1) was obtained as a result of the process described above.

(Production of Photosensitive Members (A-2) to (A-36) and (B-1) to (B-5))

The photosensitive members (A-2) to (A-36) and (B-1) to (B-5) were produced according to the same method as the method for producing the photosensitive member (A-1) in all aspects other than the following changes. The compound (CG1) was used as the charge generating material in production of the photosensitive member (A-1). By contrast, charge generating materials shown in Tables 4 and 5 were used in production of the respective photosensitive members (A-2) to (A-36) and (B-1) to (B-5). The compound (14-HT1) in an amount of 150 parts by mass was used as the hole transport material in production of the photosensitive member (A-1). By contrast, hole transport materials of types and in amounts shown in Tables 4 and 5 were used in production of the respective photosensitive members (A-2) to (A-36) and (B-1) to (B-5). The compound (ET1) in an amount of 75 parts by mass was used as the electron transport material in production of the photosensitive member (A-1). By contrast, electron transport materials of types and in amounts shown in Tables 4 and 5 were used in production of the respective photosensitive members (A-2) to (A-36) and (B-1) to (B-5). The resin (1) was used as the binder resin in production of the photosensitive member (A-1). By contrast, binder resins of types and in amounts shown in Tables 4 and 5 were used in production of the respective photosensitive members (A-2) to (A-36) and (B-1) to (B-5).

<Measurement of Optical Response Time>

Optical response times were measured for the respective photosensitive members (A-1) to (A-36) and (B-1) to (B-5). The optical response times were measured in an environment at a temperature of 25° C. and a relative humidity of 50%.

Figure 4:
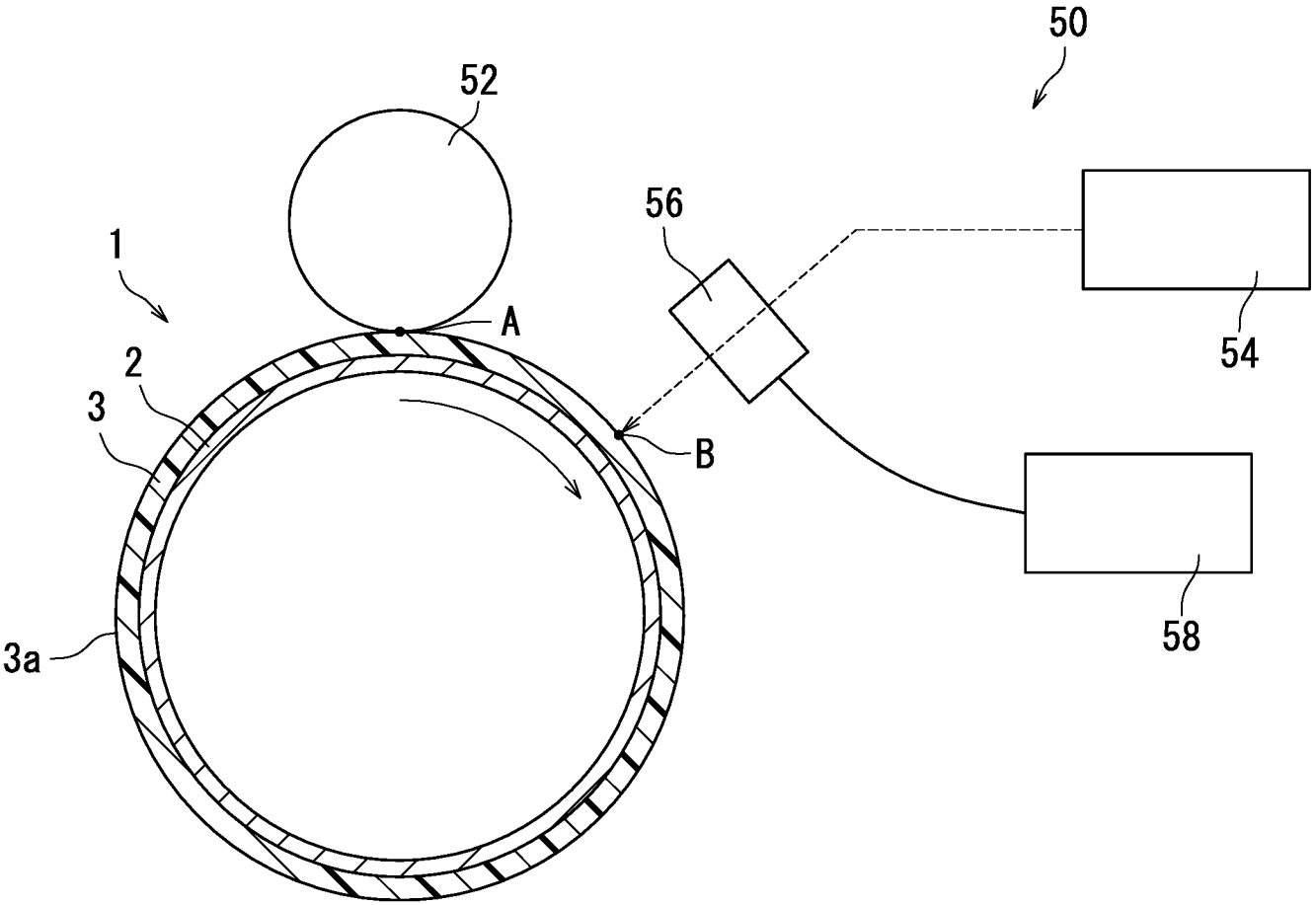
FIG. 4 is a diagram illustrating an optical response time measuring apparatus.

The following describes a method for measuring an optical response time of the photosensitive member 1 with referent to FIG. 4. FIG. 4 illustrates a measuring apparatus 50 for measurement of an optical response time of the photosensitive member 1. The measuring apparatus 50 includes a charger 52, a light exposure device 54, a transparent probe 56, and a potential detector 58. A drum sensitivity test apparatus (product of Gen-Tech, Inc.) was used as the measuring apparatus 50. First, the photosensitive member 1 (specifically, any of the photosensitive members (A-1) to (A-36) and (B-1) to (B-5)) was attached to the measuring apparatus 50.

The charger 52 was used to charge a surface 3*a* of the photosensitive layer 3 of the photosensitive member 1 to +800 V. Thus, the surface 3*a* of the photosensitive layer 3 was charged to +800 V at a charging point A. The charging point A was located at a position where the charger 52 was in contact with the surface 3*a* of the photosensitive layer 3.

The photosensitive member 1 was rotated in a direction from the charging point A to a light exposure point B (direction indicated by a solid arrow in FIG. 4) to move a point of the charged surface 3*a* of the photosensitive layer 3 charged to +800 V to the light exposure point B. The light exposure point B was located at a position to be irradiated with pule light. When the point of the charged surface 3*a* of the photosensitive layer 3 charged to +800 V reached the light exposure point B, rotation of the photosensitive member 1 was stopped and the photosensitive member 1 was secured at the light exposure point B. The potential (surface potential) of the surface 3*a* of the photosensitive layer 3 was measured with the photosensitive member 1 secured as above. The light exposure device 54 irradiated the light exposure point B of the charged surface 3*a* of the photosensitive layer 3 with pulse light (wavelength: 780 nm, half-width: 40 microseconds). An optical intensity of the pulse light was set so that the surface potential of the photosensitive layer 3 became +200 V from +800 V when 400 milliseconds elapsed after irradiation of the surface 3*a* of the photosensitive layer 3 charged to +800 V with the pulse light (more precisely, after 400 milliseconds elapsed from a time point when output of the pulse light with which the surface 3*a* of the photosensitive layer 3 is irradiated exhibits peak output). Pulse light irradiation was performed one time. That is, irradiation with a single pulse of light was performed. A xenon flash lamp ("C4479", product of Hamamatsu Photonics K.K.) was used as a light source of the light exposure device 54. Wavelength and optical intensity of the pulse light were adjusted using an optical filter (not illustrated). Technically, the surface 3*a* of the photosensitive layer 3 was charged to a value slightly larger than +800 V by the charger 52. Next, when the surface potential of the photosensitive layer 3 dark decayed to +800 V through elapse of a specific time period, the surface 3*a* of the photosensitive layer 3 was irradiated with the pulse light by the light exposure device 54.

The surface potential of the photosensitive layer 3 was measured using the transparent probe 56. The transparent probe 56 was disposed on an optical axis of the pulse light to allow the pulse light to transmit therethrough. A broken arrow from the light exposure device 54 to the photosensitive member 1 in FIG. 4 indicates the optical axis of the pulse light. A probe "3629A" (product of TREK, INC.) was used as the transparent probe 56.

The potential detector 58 was electrically connected to the transparent probe 56. The potential detector 58 obtained a surface potential of the photosensitive layer 3 each time the transparent probe 56 measured the surface potential of the photosensitive layer 3. Through the above, a surface potential decay curve for the photosensitive layer 3 was plotted. A time $\tau$ from a time of a start of the pulse light irradiation of the surface 3*a* of the photosensitive layer 3 to a time when the surface potential of the photosensitive layer 3 decayed from +800 V to +400 V was determined from the plotted decay curve. The time $\tau$ determined as above was taken to be an optical response time. The method for measuring an optical response time of the photosensitive member 1 has been described with reference to FIG. 4. The measured optical response times of the photosensitive members are shown in Tables 4 and 5.

<Image Evaluation 1: Image Defect Resulting from Exposure Memory>

Whether or not an image defect resulting from exposure memory was inhibited was evaluated for each of the photosensitive members (A-1) to (A-36) and (B-1) to (B-5). Evaluation of an image defect resulting from exposure memory was performed in an environment at a temperature of 10° C. and a relative humidity of 15%.

The photosensitive member was attached to an evaluation apparatus. The evaluation apparatus used was a modified version of a color image forming apparatus ("FS-C5250DN", product of KYOCERA Document Solutions Inc.). Modification in the modified version was removal of a cleaning blade and a static eliminator (specifically, a static elimination lamp) from the color image forming apparatus. That is, the evaluation apparatus included a scorotron charger as a charger. Furthermore, the evaluation apparatus included neither a static eliminator nor a cleaning blade that is a cleaner. The charge potential was set at +700 V. The peripheral speed of the photosensitive member was adjusted so that the process time between exposure and development was 75 milliseconds.

Figure 5:
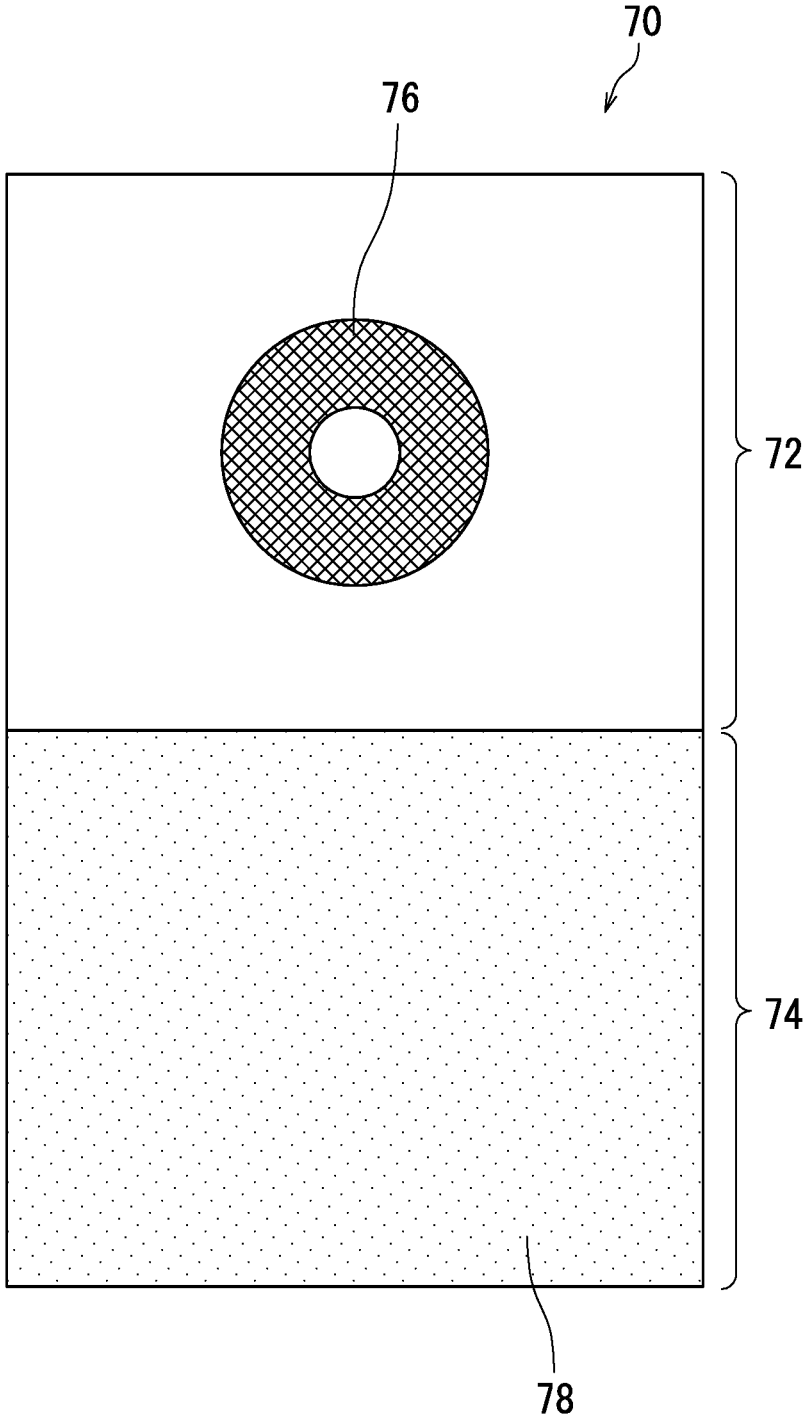
FIG. 5 is a diagram illustrating an evaluation image.

The following describes an evaluation image 70 employed in evaluation of an image defect resulting from exposure memory with reference to FIG. 5. FIG. 5 illustrates the evaluation image 70. The evaluation image 70 has a first region 72 and a second region 74. The first region 72 corresponds to a region of an image formed in the first turn of the image bearing member. The first region 72 includes a first image 76. The first image 76 is a donut-shaped solid image (image density: 100%). The solid image includes paired two concentric circles. The second region 74 corresponds to a region of an image formed in the second turn of the image bearing member. The second region 74 includes a second image 78. The second image 78 is a halftone image (image density: 40%) expanding over the entirety of the second region 74.

Figure 6:
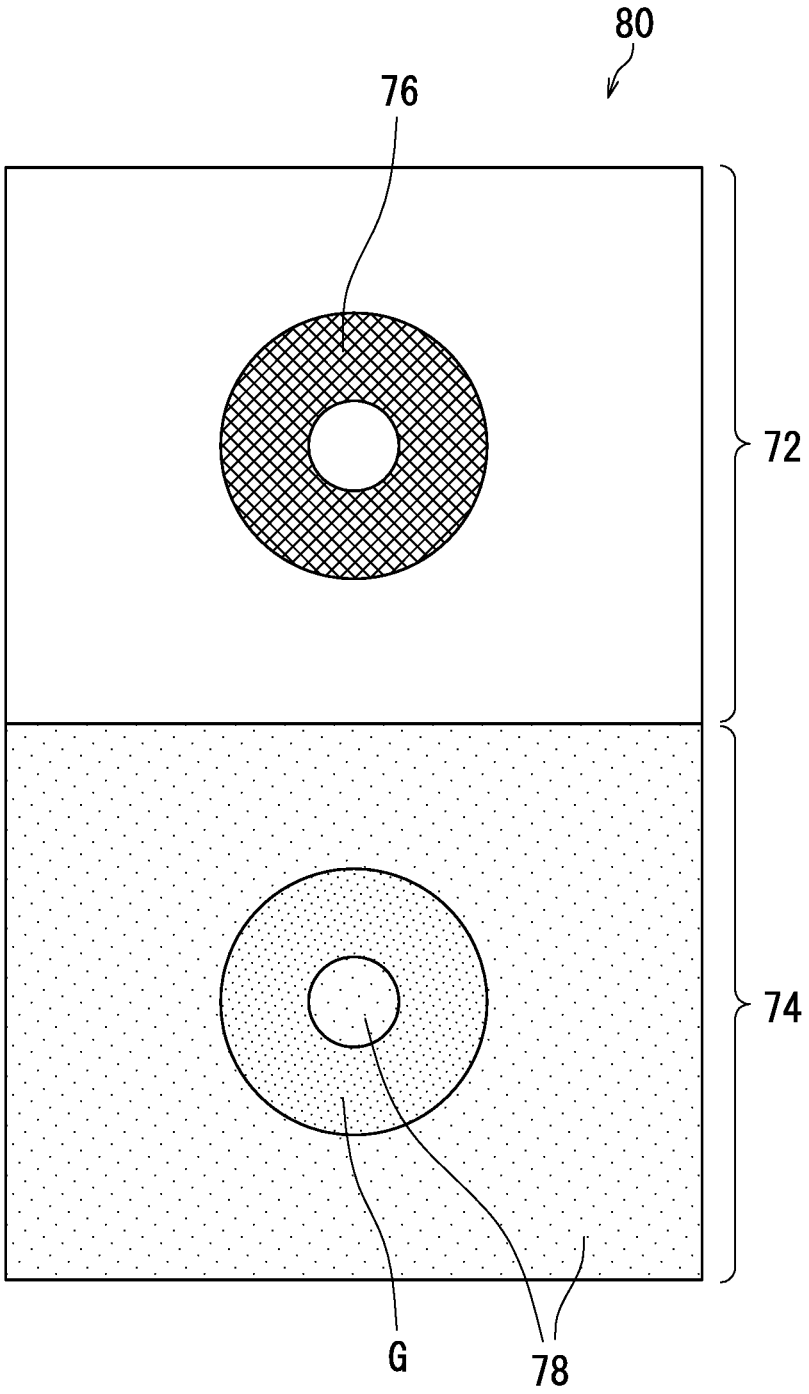
FIG. 6 is a diagram illustrating an image with an image defect resulting from exposure memory.

The following describes an image 80 with an image defect resulting from exposure memory with reference to FIG. 6. FIG. 6 illustrates the image 80 with an image defect resulting from exposure memory. The image 80 has the first region 72, the second region 74, the first image 76, and the second image 78 as in the above-described evaluation image 70. Once an image defect resulting from exposure memory occurs in printing of the evaluation image 70, a ghost image G appears in the second region 74 in addition to the second image 78 although only the second image 78 should have been printed. The ghost image G has an image density higher than that of the second image 78. The ghost image G is an image defect resulting from exposure memory and has a higher density than a designed image density due to reflection of a light exposure region corresponding to the first image 76 in the first region 72.

First, an image (print pattern image having a coverage of 4%) was printed on 3,000 recording mediums (A4-size paper) at intervals of 15 seconds using the evaluation apparatus. After the printing on 3,000 recording mediums, the evaluation image 70 illustrated in FIG. 5 was printed on one recording medium (A4-size paper). The printed evaluation image 70 was observed with an unaided eye to confirm presence or absence of an image defect resulting from exposure memory. Specifically, whether or not the ghost image G corresponding to the first image 76 appeared in the second region 74 of the evaluation image 70 was confirmed. Whether or not an image defect resulting from exposure memory could be inhibited was evaluated from results of observation on the evaluation image 70 based on the following criteria. Results of evaluation are shown in Table 6. Note that evaluations A to C were each determined to be a passing mark.

(Evaluation Criteria for Image Defect Resulting from Exposure Memory)

Evaluation A: The ghost image G corresponding to the first image 76 was not observed.

Evaluation B: The ghost image G corresponding to the first image 76 was faintly observed.

Evaluation C: The ghost image G corresponding to the first image 76 was observed which involved no practical problem.

Evaluation D: The ghost image G corresponding to the first image 76 was apparently observed which involved a practical problem.

<Evaluation of Sensitivity Stability: Measurement of Desensitization Amount>

Sensitivity stability was evaluated for each of the photosensitive members (A-1) to (A-36) and (B-1) to (B-5). Evaluation of sensitivity stability was performed in an environment at a temperature of 10° C. and a relative humidity of 15%.

First, the photosensitive member was attached to an evaluation apparatus. The evaluation apparatus used was the same as that used in evaluation of an image defect resulting from exposure memory. The charge potential was set at +700 V. The peripheral speed of the photosensitive member was adjusted so that the process time between exposure and development was 75 milliseconds.

The surface of the photosensitive member was charged to +700 V and exposed to light. A surface potential of a portion of the photosensitive member corresponding to a development position was measured, and the measured surface potential of the photosensitive member was taken to be an initial post-exposure potential $V_{L1}$ (unit: +V).

Next, test printing by which a print pattern (coverage: 4%) was printed on 3,000 recording mediums (A4-size paper) at intervals of 15 seconds was performed. The surface of the photosensitive member after the test printing was charged to +700 V and exposed to light. A surface potential of a portion of the photosensitive member corresponding to the development position was measured. The surface potential of the photosensitive member measured as above was taken to be a post-test printing post-exposure potential $V_{L2}$ (unit: +V). The light quantity of the light exposure was a light quantity necessary for formation of a halftone image (image density: 60%).

A desensitization amount (unit: +V) was calculated from the measured initial post-exposure potential $V_{L1}$ and the measured post-test printing post-exposure potential $V_{L2}$ based on the following equation (1). Sensitivity stability was evaluated from the calculated desensitization amount based on the following criteria. The calculated desensitization amounts and results of evaluation are shown in Table 6. Note that evaluations A to C were each determined to be a passing mark.

$$\text{Desensitization amount} = V_{L2} - V_{L1} \quad (1)$$

(Evaluation Criteria for Sensitivity Stability)

Evaluation A: Desensitization amount was less than 10 V.

Evaluation B: Desensitization amount was at least 10 V and less than 25 V.

Evaluation C: Desensitization amount was at least 25 V and less than 40 V.

Evaluation D: Desensitization amount was at least 40 V.

<Image Evaluation 2: Evaluation of Image Defect Resulting from Scratch or Filming>

Whether or not an image defect resulting from a scratch or filming was inhibited was evaluated for each of the photosensitive members (A-1) to (A-36) and (B-1) to (B-5). Evaluation of an image defect resulting from a scratch or filming was performed in an environment at a temperature of 10° C. and a relative humidity of 15%.

First, the photosensitive member was attached to an evaluation apparatus. The evaluation apparatus used was a modified version of a color image forming apparatus ("FS-C5250DN", product of KYOCERA Document Solutions Inc.). Modification in the modified version was removal of a cleaning blade and a static eliminator (specifically, a static elimination lamp) from the color image forming apparatus. The evaluation apparatus included a scorotron charger as a non-contact charging type charger. The evaluation apparatus included neither a static eliminator nor a cleaning blade that is a cleaner. The charge potential was set at +700 V. The peripheral speed of the photosensitive member was adjusted so that the process time between exposure and development was 70 milliseconds.

A print pattern (coverage: 1%) was printed on 10,000 recording mediums (A4-sizepaper) at intervals of 15 seconds. After the printing on 10,000 recording mediums, a halftone image and a blank image were printed as evaluation images. Whether or not the obtained evaluation images contained an image defect was observed. Whether or not an image defect resulting from a scratch or filming could be inhibited was evaluated from results of observation based on the following criteria. Note that a dash mark, a line, fogging, or a combination of any of them was taken to be an image defect resulting from a scratch or filming. Results of evaluation are shown in Table 6. Note that evaluations A to C were each determined to be a passing mark.

(Evaluation Criteria for Image Defect Resulting from Scratch or Filming)

Evaluation A: Neither a scratch nor filming was observed on a drum surface, and no image defect resulting from a scratch or filming was observed.

Evaluation B: A scratch or filming was observed on the drum surface, while no image defect resulting from the scratch or filming was observed.

Evaluation C: A slight image defect resulting from a scratch or filming was observed.

Evaluation D: An image defect resulting from a scratch or filming was observed.

In Tables 4 and 5, "CGM", "HTM", "ETM", "part", and "wt %" respectively represent the charge generating material, the hole transport material, the electron transport material, parts by mass, and percentage by mass. Furthermore, a type "12-HT3/14-HT1" and an amount "75/75" under "HTM" for the photosensitive member (A-7) in Table 4 indicate that the compounds (12-HT3) and (14-HT1) each in an amount of 75 parts by mass were contained as the hole transport material. Similarly, a type "14-HT1/12-HT10" and an amount "75/75" under "HTM" for the photosensitive member (A-14) in Table 4 indicate that the compounds (14-HT1) and (12-HT10) each in an amount of 75 parts by mass were contained as the hole transport material.

In Tables 4 and 5, "Content" in "HTM" represents a content of the hole transport material relative to a mass of the photosensitive layer. The content of the hole transport material relative to the mass of the photosensitive layer was calculated based on a calculation expression "content (unit: % by mass)=100×mass of hole transport material (unit: part by mass)/[mass of charge generating material (unit: part by mass)+mass of hole transport material (unit: part by mass)+mass of electron transport material (unit: part by mass)+mass of binder resin (unit: part by mass)]".

In Tables 4 and 5, "Ratio $m_{HTM}/m_{ETM}$" represents a ratio of a mass $m_{HTM}$ of the hole transport material to a mass $m_{ETM}$ of the electron transport material. The ratio $m_{HTM}/m_{ETM}$ was calculated based on a calculation expression "ratio $m_{HTM}/m_{ETM}$=mass of hole transport material (unit: part by mass)/mass of electron transport material (unit: part by mass)".

In Tables 4 and 5, "Ratio $(m_{HTM}+m_{ETM})/m_R$" represents a ratio of a total mass of the electron transport material and the hole transport material (mass $m_{ETM}$+mass $m_{HTM}$) to a mass $m_R$ of the binder resin. The ratio $(m_{HTM}+m_{ETM})/m_R$ was calculated based on a calculation expression "ratio $(m_{HTM}+m_{ETM})/m_R$=[mass of hole transport material (unit: part by mass)+mass of electron transport material (unit: part by mass)]/mass of binder resin (unit: part by mass)".

TABLE 4

| | | Photosensitive layer | | | | | | | | | |
|---|---|---|---|---|---|---|---|---|---|---|---|
| | | | HTM | | | ETM | | | | | |
| | Photo-sensitive member | CGM | Type | Amount [part] | Content [wt %] | Type | Amount [Part] | Ratio $m_{HTM}/m_{ETM}$ | Binder resin | Ratio $(m_{HTM}+m_{ETM})/m_R$ | Optical response time [ms] |
| Example 1 | A-1 | CG1 | 14-HT1 | 150 | 46 | ET1 | 75 | 2.0 | Resin (1) | 2.25 | 0.33 |
| Example 2 | A-2 | CG1 | 14-HT1 | 90 | 38 | ET1 | 45 | 2.0 | Resin (1) | 1.35 | 0.74 |
| Example 3 | A-3 | CG1 | 14-HT1 | 220 | 51 | ET1 | 110 | 2.0 | Resin (1) | 3.30 | 0.25 |
| Example 4 | A-4 | CG1 | 14-HT1 | 280 | 64 | ET1 | 55 | 5.1 | Resin (1) | 3.35 | 0.82 |
| Example 5 | A-5 | CG1 | 14-HT1 | 260 | 56 | ET1 | 100 | 2.6 | Resin (1) | 3.60 | 0.45 |
| Example 6 | A-6 | CG1 | 14-HT2 | 150 | 46 | ET1 | 75 | 2.0 | Resin (1) | 2.25 | 0.25 |
| Example 7 | A-7 | CG1 | 12-HT3/14-HT1 | 75/75 | 46 | ET1 | 75 | 2.0 | Resin (1) | 2.25 | 0.32 |
| Example 8 | A-8 | CG1 | 12-HT4 | 150 | 46 | ET1 | 75 | 2.0 | Resin (1) | 2.25 | 0.33 |
| Example 9 | A-9 | CG1 | 12-HT5 | 150 | 46 | ET1 | 75 | 2.0 | Resin (1) | 2.25 | 0.26 |
| Example 10 | A-10 | CG1 | 12-HT6 | 150 | 46 | ET1 | 75 | 2.0 | Resin (1) | 2.25 | 0.25 |
| Example 11 | A-11 | CG1 | 16-HT7 | 150 | 46 | ET1 | 75 | 2.0 | Resin (1) | 2.25 | 0.35 |
| Example 12 | A-12 | CG1 | 11-HT8 | 150 | 46 | ET1 | 75 | 2.0 | Resin (1) | 2.25 | 0.43 |
| Example 13 | A-13 | CG1 | 11-HT9 | 150 | 46 | ET1 | 75 | 2.0 | Resin (1) | 2.25 | 0.48 |
| Example 14 | A-14 | CG1 | 14-HT1/12-HT10 | 75/75 | 46 | ET1 | 75 | 2.0 | Resin (1) | 2.25 | 0.32 |
| Example 15 | A-15 | CG1 | 12-HT11 | 150 | 46 | ET1 | 75 | 2.0 | Resin (1) | 2.25 | 0.34 |
| Example 16 | A-16 | CG1 | 12-HT12 | 150 | 46 | ET1 | 75 | 2.0 | Resin (1) | 2.25 | 0.35 |
| Example 17 | A-17 | CG1 | 15-HT13 | 150 | 46 | ET1 | 75 | 2.0 | Resin (1) | 2.25 | 0.46 |
| Example 18 | A-18 | CG1 | 15-HT14 | 150 | 46 | ET1 | 75 | 2.0 | Resin (1) | 2.25 | 0.50 |
| Example 19 | A-19 | CG1 | 15-HT15 | 150 | 46 | ET1 | 75 | 2.0 | Resin (1) | 2.25 | 0.54 |

TABLE 5

| | | Photosensitive layer | | | | | | | | | |
|---|---|---|---|---|---|---|---|---|---|---|---|
| | | | HTM | | | ETM | | Ratio | | Ratio | Optical |
| | Photosensitive member | CGM | Type | Amount [part] | Content [wt %] | Type | Amount [part] | $m_{HTM}/m_{ETM}$ | Binder resin | $(m_{HTM}+m_{ETM})/m_R$ | response time [ms] |
| Example 20 | A-20 | CG1 | 13-HT16 | 150 | 46 | ET1 | 75 | 2.0 | Resin (1) | 2.25 | 0.61 |
| Example 21 | A-21 | CG1 | 13-HT17 | 150 | 46 | ET1 | 75 | 2.0 | Resin (1) | 2.25 | 0.59 |
| Example 22 | A-22 | CG1 | 12-HT18 | 150 | 46 | ET1 | 75 | 2.0 | Resin (1) | 2.25 | 0.55 |
| Example 23 | A-23 | CG1 | 17-HT19 | 150 | 46 | ET1 | 75 | 2.0 | Resin (1) | 2.25 | 0.24 |
| Example 24 | A-24 | CG1 | 14-HT1 | 150 | 46 | ET2 | 75 | 2.0 | Resin (1) | 2.25 | 0.32 |
| Example 25 | A-25 | CG1 | 14-HT1 | 150 | 46 | ET3 | 75 | 2.0 | Resin (1) | 2.25 | 0.35 |
| Example 26 | A-26 | CG2 | 14-HT1 | 150 | 46 | ET1 | 75 | 2.0 | Resin (1) | 2.25 | 0.32 |
| Example 27 | A-27 | CG1 | 14-HT1 | 150 | 46 | ET1 | 75 | 2.0 | Resin (2) | 2.25 | 0.33 |
| Example 28 | A-28 | CG1 | 14-HT1 | 150 | 46 | ET1 | 75 | 2.0 | Resin (3) | 2.25 | 0.34 |
| Example 29 | A-29 | CG1 | 14-HT1 | 150 | 46 | ET1 | 75 | 2.0 | Resin (4) | 2.25 | 0.33 |
| Example 30 | A-30 | CG1 | 14-HT1 | 150 | 46 | ET1 | 75 | 2.0 | Resin (5) | 2.25 | 0.41 |
| Example 31 | A-31 | CG1 | 14-HT1 | 150 | 46 | ET1 | 75 | 2.0 | Resin (6) | 2.25 | 0.36 |
| Example 32 | A-32 | CG1 | 14-HT1 | 150 | 46 | ET1 | 75 | 2.0 | Resin (7) | 2.25 | 0.38 |
| Example 33 | A-33 | CG1 | 14-HT1 | 150 | 46 | ET1 | 75 | 2.0 | Resin (8) | 2.25 | 0.30 |
| Example 34 | A-34 | CG1 | 14-HT1 | 150 | 46 | ET1 | 75 | 2.0 | Resin (9) | 2.25 | 0.30 |
| Example 35 | A-35 | CG1 | 14-HT1 | 150 | 46 | ET1 | 75 | 2.0 | Resin (10) | 2.25 | 0.34 |
| Example 36 | A-36 | CG1 | 18-HT21 | 150 | 46 | ET1 | 75 | 2.0 | Resin (1) | 2.25 | 0.23 |
| Comparative Example 1 | B-1 | CG1 | 14-HT1 | 50 | 22 | ET1 | 70 | 0.7 | Resin (1) | 1.20 | 83.00 |
| Comparative Example 2 | B-2 | CG1 | 14-HT1 | 70 | 31 | ET1 | 50 | 1.4 | Resin (1) | 1.20 | 2.70 |
| Comparative Example 3 | B-3 | CG1 | HT20 | 150 | 46 | ET1 | 75 | 2.0 | Resin (1) | 2.25 | 3.40 |
| Comparative Example 4 | B-4 | CG1 | 14-HT1 | 150 | 46 | ET1 | 75 | 2.0 | Resin (11) | 2.25 | 0.32 |
| Comparative Example 5 | B-5 | CG1 | 14-HT1 | 150 | 46 | ET1 | 75 | 2.0 | Resin (12) | 2.25 | 0.40 |

TABLE 6

| | Photo-sensitive member | Sensitivity stability $V_{L2}-V_{L1}$ [−V] | Sensitivity stability Evalu-ation | Inhibition of scratch or filming | Inhibition of exposure memory |
|---|---|---|---|---|---|
| Example 1 | A-1 | 14 | B | A | A |
| Example 2 | A-2 | 30 | C | A | C |
| Example 3 | A-3 | 8 | A | A | A |
| Example 4 | A-4 | 22 | B | A | A |
| Example 5 | A-5 | 34 | C | B | C |
| Example 6 | A-6 | 3 | A | A | A |
| Example 7 | A-7 | 8 | A | B | A |
| Example 8 | A-8 | 10 | B | B | A |
| Example 9 | A-9 | 4 | A | C | A |
| Example 10 | A-10 | 4 | A | B | A |
| Example 11 | A-11 | 6 | A | A | A |
| Example 12 | A-12 | 12 | B | A | B |
| Example 13 | A-13 | 15 | B | A | C |
| Example 14 | A-14 | 8 | A | A | A |
| Example 15 | A-15 | 11 | B | A | A |
| Example 16 | A-16 | 12 | B | A | A |
| Example 17 | A-17 | 15 | B | A | B |
| Example 18 | A-18 | 16 | B | A | C |
| Example 19 | A-19 | 20 | B | A | C |
| Example 20 | A-20 | 22 | B | A | C |
| Example 21 | A-21 | 23 | B | A | C |
| Example 22 | A-22 | 22 | B | A | C |
| Example 23 | A-23 | 3 | A | A | A |
| Example 24 | A-24 | 9 | A | A | A |
| Example 25 | A-25 | 9 | A | A | A |
| Example 26 | A-26 | 9 | A | A | A |
| Example 27 | A-27 | 10 | B | A | A |
| Example 28 | A-28 | 13 | B | B | A |
| Example 29 | A-29 | 10 | B | A | A |
| Example 30 | A-30 | 9 | A | B | A |
| Example 31 | A-31 | 11 | B | A | A |
| Example 32 | A-32 | 13 | B | A | A |
| Example 33 | A-33 | 13 | B | A | A |
| Example 34 | A-34 | 15 | B | B | A |
| Example 35 | A-35 | 16 | B | A | A |
| Example 36 | A-36 | 3 | A | A | A |
| Comparative Example 1 | B-1 | 253 | D | A | D |
| Comparative Example 2 | B-2 | 53 | D | A | D |

TABLE 6-continued

| | Photo-sensitive member | Sensitivity stability $V_{L2}-V_{L1}$ [−V] | Sensitivity stability Evalu-ation | Inhibition of scratch or filming | Inhibition of exposure memory |
|---|---|---|---|---|---|
| Comparative Example 3 | B-3 | 68 | D | B | D |
| Comparative Example 4 | B-4 | 14 | B | D | B |
| Comparative Example 5 | B-5 | 18 | B | D | B |

Each of the photosensitive members (A-1) to (A-36) included a conductive substrate and a photosensitive layer of a single layer. The photosensitive layer contained a charge generating material, a hole transport material, an electron transport material, and a binder resin. The photosensitive members (A-1) to (A-36) each had an optical response time of at least 0.05 milliseconds and no greater than 0.85 milliseconds. The photosensitive layer of each of the photosensitive members (A-1) to (A-36) contained the polycarbonate resin (10) as the binder resin. The photosensitive layer of each of the photosensitive members (A-1) to (A-36) contained one or two of the compounds (14-HT1), (14-HT2), (12-HT3), (12-HT4), (12-HT5), (12-HT6), (16-HT7), (11-HT8), (11-HT9), (12-HT10), (12-HT11), (12-HT12), (15-HT13), (15-HT14), (15-HT15), (13-HT16), (13-HT17), (12-HT18), (17-HT19), and (18-HT21) as the hole transport material. As a result, as shown in Table 6, each of the photosensitive members (A-1) to (A-36) was evaluated as any of A to C in evaluation of sensitivity stability, any of A to C in evaluation of inhibition of an image defect resulting from a scratch or filming, and any of A to C in evaluation of inhibition of an image defect resulting from exposure memory. The above means that each of the photosensitive members (A-1) to (A-36) made passing marks in each evaluation. That is, each of the photosensitive members (A-1) to (A-36) was excellent in sensitivity stability and use of any of the photosensitive members (A-1) to (A-36) could inhibit both an image defect resulting from a scratch or filming and an image defect resulting from exposure memory.

By contrast, the optical response time of each of the photosensitive members (B-1) to (B-3) exceeded 0.85 milliseconds. As a result, each of the photosensitive members (B-1) to (B-3) was evaluated as D in evaluation of sensitivity stability and evaluation of inhibition of an image defect resulting from exposure memory, as shown in Table 6. That is, sensitivity stability was insufficient and an image defect resulting from exposure memory could be insufficiently inhibited with use of any of the photosensitive members (B-1) to (B-3).

Both of the photosensitive members (B-4) and (B-5) contained a polycarbonate resin that was a homopolymer as the binder resin rather than the polycarbonate resin (10). As a result, both the photosensitive members (B-4) and (B-5) were evaluated as D in evaluation of inhibition of an image defect resulting from a scratch or filming and an image defect resulting from a scratch or filming was not inhibited, as shown in Table 6. That is, an image defect resulting from a scratch of filming could be insufficiently inhibited with use of any of the photosensitive members (B-4) to (B-5).

The above indicates that an image defect resulting from exposure memory and an image defect resulting from a scratch or filming could be inhibited and excellent sensitivity stability could be achieved with use of the photosensitive member according to the present disclosure. Furthermore, the above indicates that an image defect resulting from exposure memory and an image defect resulting from a scratch or filming could be inhibited and excellent sensitivity stability of the photosensitive member could be achieved with use of the process cartridge or the image forming apparatus according to the present disclosure.

What is claimed is:

1. An electrophotographic photosensitive member comprising a conductive substrate and a photosensitive layer of a single layer, wherein the photosensitive layer contains a charge generating material, a hole transport material, an electron transport material, and a binder resin, an optical response time is at least 0.05 milliseconds and no greater than 0.85 milliseconds, the optical response time is a time from irradiation to decay, the irradiation being a time of a start of irradiation of a surface of the photosensitive layer charged to +800 V with pulse light having a wavelength of 780 nm, the decay being a time when a surface potential of the photosensitive layer decays from +800 V to +400 V, an optical intensity of the pulse light is set so that the surface potential of the photosensitive layer becomes +200 V from +800 V when 400 milliseconds elapse after the irradiation of the surface of the photosensitive layer charged to +800 V with the pulse light, the binder resin includes a polycarbonate resin including a repeating unit represented by a general formula (1) shown below and a repeating unit represented by a general formula (2) shown below, and the hole transport material is a compound represented by a chemical formula (16-HT7), (17-HT19), or (18-HT21) shown below, (1)

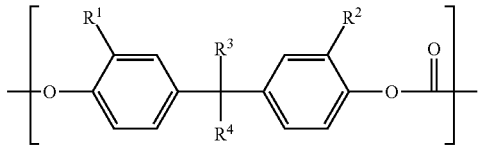

(2)

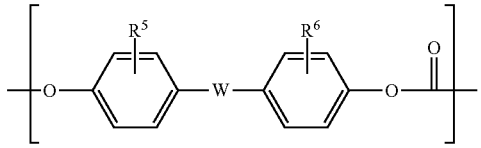

where in the general formula (1), $R^1$, $R^2$, $R^3$, and $R^4$ each represent, independently of one another, a hydrogen atom, an alkyl group having a carbon number of at least 1 and no greater than 3 and optionally substituted by a halogen atom, or an aryl group having a carbon number of at least 6 and no greater than 14, and $R^3$ and $R^4$ may be bonded together to form a ring of a divalent group represented by a general formula (X) shown below, in the general formula (2), $R^5$ and $R^6$ each represent, independently of each other, a hydrogen atom or an alkyl group having a carbon number of at least 1 and no greater than 3 and optionally substituted by a substituent, and W represents a single bond, —O—, or —CO—, (X)

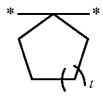

where in the general formula (X), t represents an integer of at least 1 and no greater than 3, and

* represents a bond, (16-HT7)

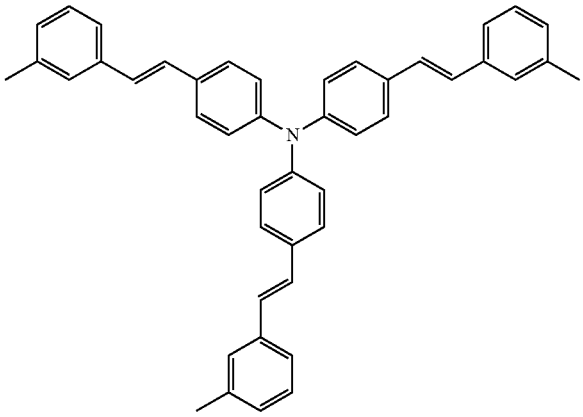

-continued (17-HT19)

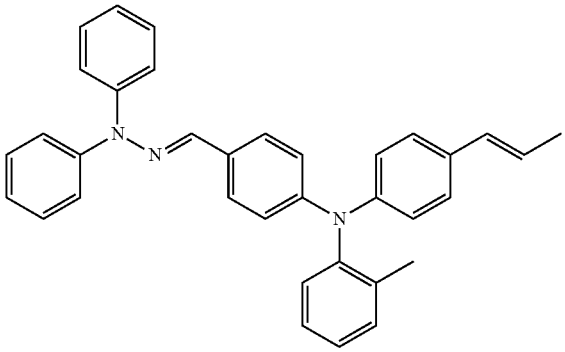

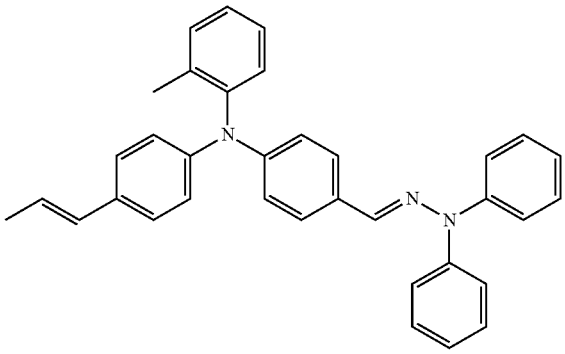

(18-HT21)

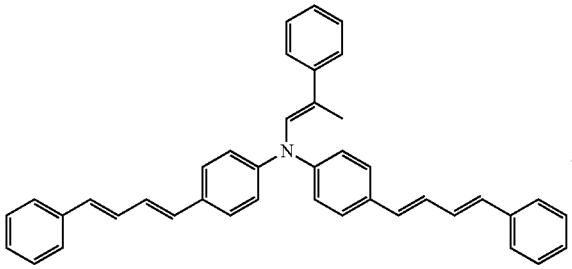

2. The electrophotographic photosensitive member according to claim 1, wherein a ratio $m_{HTM}/m_{ETM}$ of a mass $m_{HTM}$ of the hole transport material to a mass $m_{ETM}$ of the electron transport material is at least 1.2 and no greater than 4.0.

3. The electrophotographic photosensitive member according to claim 1, wherein a mass $m_{HTM}$ of the hole transport material, a mass $m_{ETM}$ of the electron transport material, and a mass $m_R$ of the binder resin satisfy a relational expression (A):

$$[(m_{HTM}+m_{ETM})/m_R]>1.30 \quad \text{(A).}$$

4. The electrophotographic photosensitive member according to claim 1, wherein a content of the hole transport material relative to a mass of the photosensitive layer is at least 35% by mass and no greater than 65% by mass.

5. The electrophotographic photosensitive member according to claim 1, wherein the optical response time is at least 0.05 milliseconds and no greater than 0.60 milliseconds.

6. The electrophotographic photosensitive member according to claim 1, wherein the repeating unit represented by the general formula (1) is a repeating unit represented by any one of chemical formulas (1-1), (1-2), (1-3), and (1-4) shown below, (1-1)

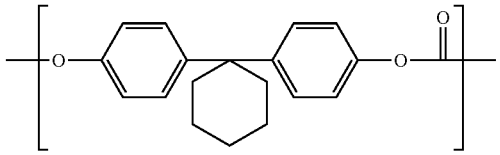

(1-2)

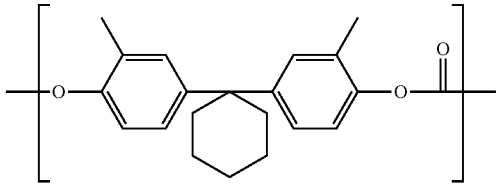

(1-3)

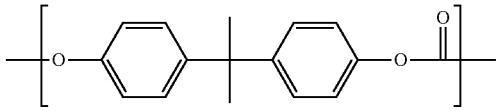

(1-4)

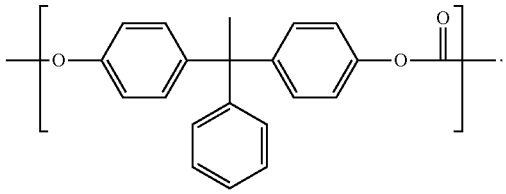

7. The electrophotographic photosensitive member according to claim 6, wherein the polycarbonate resin is any one of:

a first polycarbonate resin including a repeating unit represented by the chemical formula (1-1) shown below and a repeating unit represented by a chemical formula (2-1) shown below;

a second polycarbonate resin including a repeating unit represented by the chemical formula (1-2) shown below and the repeating unit represented by the chemical formula (2-1);

a third polycarbonate resin including a repeating unit represented by the chemical formula (1-3) shown below and the repeating unit represented by the chemical formula (2-1);

a fourth polycarbonate resin including a repeating unit represented by the chemical formula (1-4) shown below and a repeating unit represented by a chemical formula (2-2) shown below;

a fifth polycarbonate resin including the repeating unit represented by the chemical formula (1-1) and a repeating unit represented by a chemical formula (2-3) shown below;

a sixth polycarbonate resin including the repeating unit represented by the chemical formula (1-2) and the repeating unit represented by the chemical formula (2-3);

a seventh polycarbonate resin including the repeating unit represented by the chemical formula (1-2) and a repeating unit represented by a chemical formula (2-4) shown below; and an eighth polycarbonate resin including the repeating unit represented by the chemical formula (1-1) and the repeating unit represented by the chemical formula (2-2), (1-1)

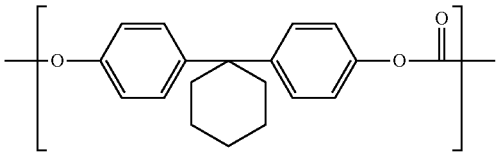

(1-2)

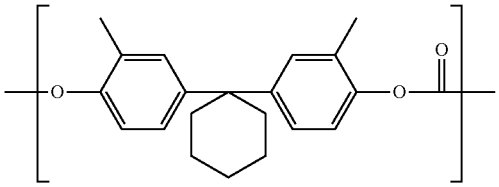

(1-3)

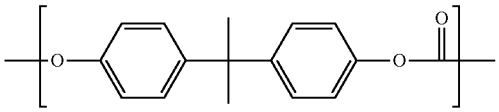

(1-4)

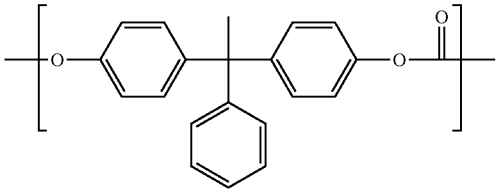

(2-1)

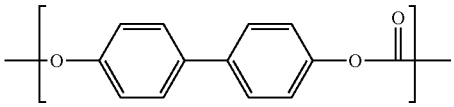

(2-2)

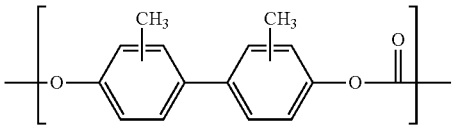

(2-3)

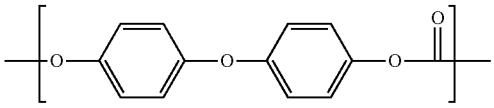

(2-4)

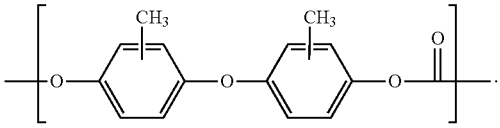

8. The electrophotographic photosensitive member according to claim 1, wherein the repeating unit represented by the general formula (2) is a repeating unit represented by any one of chemical formulas (2-1), (2-2), (2-3), and (2-4) shown below, (2-1)

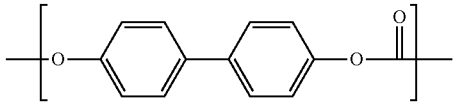

(2-2)

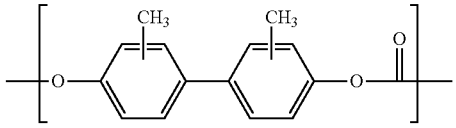

(2-3)

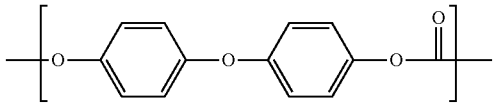

(2-4)

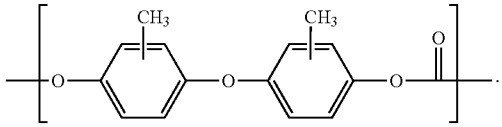

9. The electrophotographic photosensitive member according to claim 1, wherein the electron transport material includes at least one of compounds represented by general formulas (21), (22), and (23) shown below, (21)

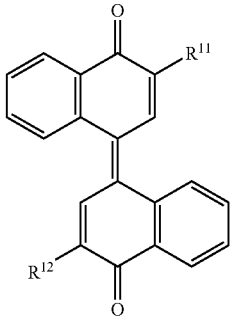

(22)

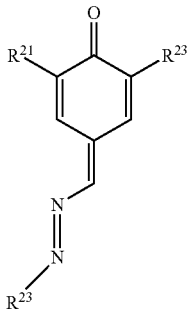

(23)

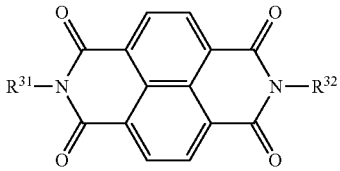

where in the general formula (21), $R^{11}$ and $R^{12}$ each represent, independently of each other, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20, in the general formula (22), $R^{21}$, $R^{22}$, and $R^{23}$ each represent, independently of one another, a halogen atom, an alkyl group having a carbon number of at least 1 and no greater than 6, an alkoxy group having a carbon number of at least 1 and no greater than 6, an aryl group having a carbon number of at least 6 and no greater than 14 and optionally substituted by a halogen atom, an aralkyl group having a carbon number of at least 7 and no greater than 20, or a heterocyclic group having at least 5 members and no greater than 14 members, and in the general formula (23), $R^{31}$ and $R^{32}$ each represent, independently of each other, a halogen atom, an amino group, an alkyl group having a carbon number of at least 1 and no greater than 6, an alkoxy group having a carbon number of at least 1 and no greater than 6, or an aryl group having a carbon number of at least 6 and no greater than 14 and optionally substituted by a substituent.

10. The electrophotographic photosensitive member according to claim 1, wherein the electron transport material includes at least one of compounds represented by general formulas (ET1), (ET2), and (ET3) shown below, (ET1)

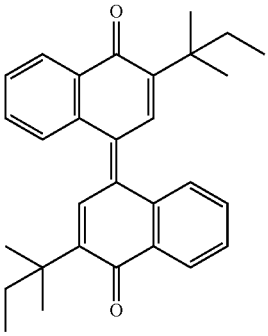

-continued (ET2)

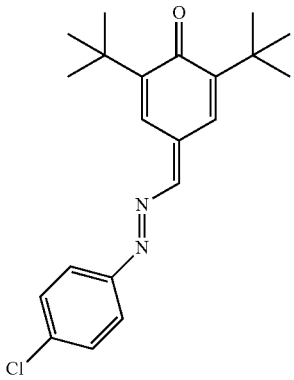

(ET3)

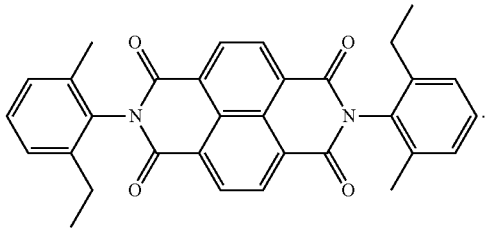

11. An image forming apparatus comprising:

an image bearing member;

a charger configured to charge a surface of the image bearing member;

a light exposure section configured to expose the charged surface of the image bearing member to light to form an electrostatic latent image on the surface of the image bearing member;

a developing section configured to develop the electrostatic latent image into a toner image; and a transfer section configured to transfer the toner image from the image bearing member to a transfer target, wherein the charger positively charges the surface of the image bearing member, and the image bearing member is the electrophotographic photosensitive member according to claim 1.

* * * * *